US009779892B2

(12) United States Patent
Kobayashi et al.

(10) Patent No.: US 9,779,892 B2
(45) Date of Patent: Oct. 3, 2017

(54) POWER SWITCHING CONTROL APPARATUS FOR SWITCHING TIMINGS OF BREAKER TO SUPPRESS TRANSIT VOLTAGE AND CURRENT UPON TURNING ON THE BREAKER

(71) Applicants: Shoichi Kobayashi, Chiyoda-ku (JP); Takashi Shindoi, Chiyoda-ku (JP); Kenji Inomata, Chiyoda-ku (JP); Tomohito Mori, Chiyoda-ku (JP); Daigo Matsumoto, Chiyoda-ku (JP); Aya Yamamoto, Chiyoda-ku (JP)

(72) Inventors: Shoichi Kobayashi, Chiyoda-ku (JP); Takashi Shindoi, Chiyoda-ku (JP); Kenji Inomata, Chiyoda-ku (JP); Tomohito Mori, Chiyoda-ku (JP); Daigo Matsumoto, Chiyoda-ku (JP); Aya Yamamoto, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 377 days.

(21) Appl. No.: 14/441,008

(22) PCT Filed: Dec. 14, 2012

(86) PCT No.: PCT/JP2012/082499
§ 371 (c)(1),
(2) Date: May 6, 2015

(87) PCT Pub. No.: WO2014/091618
PCT Pub. Date: Jun. 19, 2014

(65) Prior Publication Data
US 2015/0294814 A1 Oct. 15, 2015

(51) Int. Cl.
*H01H 9/56* (2006.01)
*H01H 33/59* (2006.01)

(52) U.S. Cl.
CPC ..... *H01H 9/56* (2013.01); *H01H 9/563* (2013.01); *H01H 33/593* (2013.01)

(58) Field of Classification Search
CPC ..... H01H 9/56; H01H 9/563; H01H 33/593
(Continued)

(56) References Cited

U.S. PATENT DOCUMENTS 6,172,863 B1 1/2001 Ito et al.
6,433,980 B1 8/2002 Tsutada et al.
(Continued)

FOREIGN PATENT DOCUMENTS

CA 2 326 091 A1 5/2001
CA 2 766 334 A1 12/2010
(Continued)

OTHER PUBLICATIONS

Office Action dated May 31, 2016 in Canadian Patent Application No. 2,889,935.
(Continued)

*Primary Examiner* — Thienvu Tran
*Assistant Examiner* — Kevin J Comber
(74) *Attorney, Agent, or Firm* — Oblon, McClelland, Maier & Neustadt, L.L.P.

(57) ABSTRACT

A target pole-close timing determining unit corrects a breaker characteristic correction signal of a preceding turn-on phase by using a correction amount which is proportional to an absolute value of the interpolar voltage upon turn-on of the proceeding turn-on phase, and a correction amount which is proportional to an elapsed time after a target pole-close timing of the preceding turn-on phase, to generate a subsequent phase interpolar voltage signal, and determines a target pole-close timing of the subsequent turn-on phase at a timing when the subsequent phase interpolar voltage signal is equal to or smaller than a threshold value.

17 Claims, 18 Drawing Sheets

(58) Field of Classification Search
USPC ..... 361/115
See application file for complete search history.

(56) References Cited

U.S. PATENT DOCUMENTS

| | | | |
|---|---|---|---|
| 6,493,203 | B1 | 12/2002 | Ito et al. |
| 2008/0211317 | A1 | 9/2008 | Pilz et al. |
| 2012/0103767 | A1 | 5/2012 | Göschel et al. |
| 2013/0221760 | A1 | 8/2013 | Mori et al. |

FOREIGN PATENT DOCUMENTS

| | | | |
|---|---|---|---|
| CA | 2 823 234 | A1 | 7/2012 |
| EP | 1 098 333 | A2 | 5/2001 |
| JP | 2003 168335 | | 6/2003 |
| JP | 2008 529227 | | 7/2008 |
| JP | 4799712 | | 10/2011 |

OTHER PUBLICATIONS

Official Action dated Feb. 20, 2017 in Canadian Patent Application No. 2,889,935.
International Preliminary Report on Patentability and Written Opinion dated Jun. 25, 2015 in PCT/JP2012/082499.
International Search Report dated Jan. 15, 2013 in PCT/JP12/082499 filed Dec. 14, 2012.

POWER SWITCHING CONTROL APPARATUS FOR SWITCHING TIMINGS OF BREAKER TO SUPPRESS TRANSIT VOLTAGE AND CURRENT UPON TURNING ON THE BREAKER

TECHNICAL FIELD

The present invention relates to a power switching control apparatus for controlling switching timings of a breaker, and a control method thereof. In particular, the present invention relates to a power switching control apparatus for suppressing transit voltage and current generated when a breaker is turned on and a control method thereof.

BACKGROUND ART

Controlling a power switching apparatus such as a breaker to automatically close a circuit within a short time interval of, for example, one second subsequently to circuit opening operation is called "a high-speed reclose". For example, in the case of a power transmission line accident that is mostly a flashover accident of an insulator by a thunderbolt, a secondary arc current attributed to the accident automatically disappears if the fault section is once separated from the power source by opening the circuit of the breaker between the power source and a power transmission line. Therefore, any accident does not occur again if a breaker circuit is closed by performing high-speed reclose, and the operation can be performed without abnormality. In this case, it is required to appropriately control a pole-close timing of the breaker in order to suppress generation of transit voltage and current at the timing of turning on the breaker at a reclose timing.

For example, the power switching control apparatus described in a Patent Document 1 makes a functional approximation of the measured waveforms of a power source side voltage of the breaker and the load side voltage of the breaker and estimates the interpolar voltage at and after the current time by using an approximation function. Then, the estimated interpolar voltage is corrected based on a pre-arc characteristic of the breaker and the mechanical operation variation characteristic of the breaker, the target pole-close timing is determined by using the corrected interpolar voltage, and the breaker pole is closed at the determined target pole-close timing.

In the Patent Document 1, there is no description about the determining method of the target pole-close timing of each phase when the three-phase breaker is sequentially turned on every phase. However, when the breaker between the power source and the three-phase balanced transmission line is sequentially closed respective phases, there is a possibility that load side voltages of the second and third turn-on phases are varied by receiving the influence of turning on the preceding turn-on phase (hereinafter, referred to as a preceding turn-on phase). For this reason, if the target pole-close timings of the second and third turn-on phases are determined, respectively, by using the interpolar voltages of the second and third turn-on phases estimated immediately after current interruption by closing the circuit of the breaker and the second and third turn-on phases are closed at the target pole-close timings, the transit voltage and current at the timing of turning on the breaker cannot be suppressed.

In order to solve this problem, the power switching control apparatus described in a Patent Document 2 delays a pole-close possible timing that is the start timing of the pole-close timing domain by a predetermined delay time interval with estimation of a fluctuation in the breaker interpolar voltage due to the turning-on of the preceding turn-on phase when calculating the pole-close timing domain of the subsequent turn-on phases after the second turn-on phase. Moreover, the power switching control apparatus described in the Patent Document 2 applies a breaker interpolar voltage maximum fluctuation value which is previously set with estimation of the fluctuation in the breaker interpolar voltage due to the turning-on of the preceding turn-on phase when estimating the breaker interpolar voltage of the subsequent turn-on phase.

PRIOR ART DOCUMENTS

Patent Documents

Patent Document 1: Japanese patent laid-open publication No. JP 2003-168335 A;

Patent Document 2: Japanese patent No. JP 4799712 B; and

Patent Document 3: Japanese patent laid-open publication No. JP 2008-529227 A.

According to the power switching control apparatus described in the Patent Document 2, the delay time interval for delaying the pole-close possible timing and the breaker interpolar voltage maximum fluctuation value applied to the breaker interpolar voltage are set by estimating in advance the fluctuation amount of the breaker interpolar voltage attributed to the turning-on of the preceding turn-on phase to a maximum degree. Therefore, there is a possibility that the aforementioned delay time interval and the breaker interpolar voltage maximum fluctuation value are larger than actually required values, respectively, and there is a possibility that the generation of the transit voltage and current at the timing of turning on the breaker cannot be suppressed.

Means for Dissolving Problems

An object of the present invention is to solve the aforementioned problems and provide a power switching control apparatus and a control method thereof, each capable of suppressing generation of transit voltage and current at the timing of turning on the breaker more reliably than that of the prior art.

According to the present invention, there is provided a power switching control apparatus including first and second voltage measuring units, a target pole-close timing determining unit, and a pole-close control unit. The first voltage measuring unit is configured to measure a first voltage that is a power source side voltage of a first contact of a breaker connected between an alternating current power source of at least two phases and a load, and a second voltage that is a power source side voltage of a second contact of the breaker. The second voltage measuring unit is configured to measure a third voltage that is a load side voltage of the first contact, and a fourth voltage that is a load side voltage of the second contact. The target pole-close timing determining unit is configured to determine a first target pole-close timing of the first contact, and a second target pole-close timing of the second contact by using the first to fourth voltages. The pole-close control unit is configured to control the first and second contacts to be closed, respectively, at first and second target pole-close timings. The target pole-close timing determining unit estimates an absolute value of an interpolar voltage of the first contact at and after a current time by using the first and third voltages, and estimates an absolute value of an interpolar voltage of the second contact at and after the current time by using the second and fourth voltages. The target pole-close timing determining unit sets the first target pole-close timing to a timing when the absolute value of the interpolar voltage of the first contact is equal to or smaller than a predetermined first threshold value. The target pole-close timing determining unit corrects an absolute value of the interpolar voltage of the second contact based on at least one of the absolute value of the interpolar voltage of the first contact at the first target pole-close timing and an elapsed time from the first target pole-close timing, and sets the second target pole-close timing to a timing when an absolute value of a corrected interpolar voltage of the second contact is equal to or smaller than the first threshold value.

Effects of the Invention

According to the power switching control apparatus and the control method thereof of the present invention, the absolute value of the interpolar voltage of the second contact is corrected based on at least one of the absolute value of the interpolar voltage of the first contact at the first target pole-close timing and the elapsed time from the first target pole-close timing, and the second target pole-close timing is set to a timing when the corrected absolute value of the interpolar voltage of the second contact is equal to or smaller than the first threshold value. Therefore, generation of transit voltage and current at the timing of turning on the breaker can be suppressed more reliably than that of the prior art.

BEST MODE FOR CARRYING OUT THE INVENTION

Figure 1:
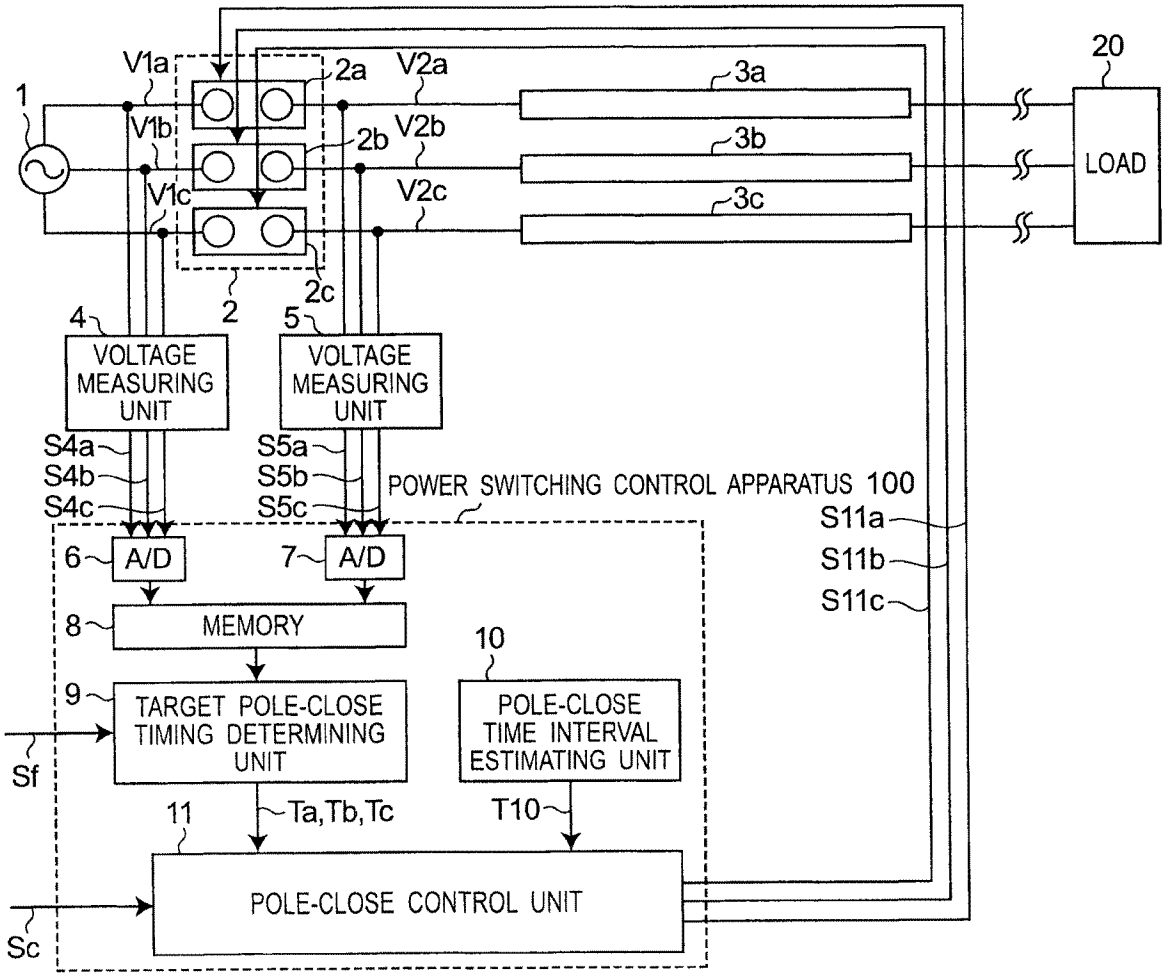
FIG. 1 is a block diagram showing a configuration of a power switching control apparatus 100 according to a first embodiment of the present invention.

Embodiments of the present invention will be described below with reference to the drawings. It is noted that like components are denoted by like reference numerals.

First Embodiment

FIG. 1 is a block diagram showing a configuration of a power switching control apparatus 100 according to a first embodiment of the present invention. Referring to FIG. 1, the power switching control apparatus 100 is configured to include A/D converters 6 and 7, a memory 8, a target pole-close timing determining unit 9, a pole-close time interval estimating unit 10, and a pole-close control unit 11.

Referring to FIG. 1, power voltages of an A phase, a B phase and a C phase from a power source 1 (hereinafter, referred to as a power source 1), which is a three-phase alternating-current power source, are outputted to a load 20, respectively, via the contacts 2*a*, 2*b* and 2*c* of a breaker 2, and power transmission lines 3*a*, 3*b* and 3*c* with three-phase balanced shunt reactor compensation. The contacts 2*a*, 2*b* and 2*c* are closed in response to pole-close control signals S11*a*, S11*b* and S11*c*, respectively, from the pole-close control unit 11. Moreover, if a failure of ground fault or the like is detected in at least one of the power transmission lines 3*a*, 3*b* and 3*c* by an apparatus of a higher layer of the power switching control apparatus 100, the contacts 2*a*, 2*b* and 2*c* are opened by the apparatus of the higher layer. Since the power transmission line 3*a* is a power transmission line with shunt reactor compensation, an alternating-current voltage of a constant frequency is generated by the reactor of the breaker 2 and the electrostatic capacitance of the power transmission line 3*a* on the load side when the contact 2*a* is opened. The frequency of this alternating-current voltage is different from the frequency of the voltage on the power source side of the contact 2*a*. Moreover, an alternating-current voltage of a constant frequency is similarly generated also on the load side of the contacts 2*b* and 2*c*.

A voltage measuring unit 4 measures the power source side voltages V1*a*, V1*b* and V1*c* of the contacts 2*a*, 2*b* and 2*c* of the breaker 2, generates measurement voltage signals S4*a*, S4*b* and S4*c* representing the respective measurement results, and outputs the resulting signals to the A/D converter 6. Moreover, a voltage measuring unit 5 measures the load side voltages V2*a*, V2*b* and V2*c* of the contacts 2*a*, 2*b* and 2*c* of the breaker 2, generates measurement voltage signals S5*a*, S5*b* and S5*c* representing the respective measurement results, and outputs the resulting signals to the A/D converter 7. It is noted that the voltage measuring units 4 and 5 are each configured to include an alternating-current voltage measurement sensor that is generally used in a high voltage circuit.

The A/D converter 6 discretizes the measurement voltage signals S4*a*, S4*b* and S4*c* at a predetermined sampling interval Δt, and outputs the resulting signals to the memory 8. Moreover, the A/D converter 7 discretizes the measurement voltage signals S5*a*, S5*b* and S5*c* at a predetermined sampling interval Δt, and outputs the resulting signals to the memory 8. The memory 8 stores the measurement voltage signals S4*a*, S4*b*, S4*c*, S5*a*, S5*b* and S5*c* for the latest predetermined interval (e.g., an interval corresponding to seven cycles of the power voltage). Further, upon receiving a fault detection signal Sf representing that a failure of ground fault or the like is detected in at least one of the power transmission lines 3*a*, 3*b* and 3*c* from the apparatus of the higher layer of the power switching control apparatus 100, the target pole-close timing determining unit 9 executes a target pole-close timing determining process described later with reference to FIG. 2. By this operation, the target pole-close timing determining unit 9 determines the target pole-close timings Ta, Tb and Tc of the contacts 2*a*, 2*b* and 2*c* for high-speed reclose of the breaker 2 by using the measurement voltage signals S4*a*, S4*b*, S4*c*, S5*a*, S5*b* and S5*c* stored in the memory 8, and outputs the same timings to the pole-close control unit 11.

The pole-close time interval estimating unit 10 estimates an estimated pole-close time interval T10 that is a time interval from when the pole-close control unit 11 outputs the pole-close control signal S11*a* to the contact 2*a* to when the contact 2*a* is mechanically brought in contact by using a known technology (See, for example, the Patent Documents 1 and 2), and outputs the time interval to the pole-close control unit 11. It is noted that the estimated pole-close time intervals of the contacts 2*b* and 2*c* are identical to the estimated pole-close time interval T10 of the contact 2*a*.

The pole-close control unit 11 generates pole-close control signals S11*a*, S11*b* and S11*c* so that the contacts 2*a*, 2*b* and 2*c* are closed at the target pole-close timings Ta, Tb and Tc, respectively, in response to a pole-close command signal Sc from the apparatus of the higher layer of the power switching control apparatus 100, and outputs the signals to the contacts 2*a*, 2*b* and 2*c*. In concrete, the pole-close control unit 11 outputs the pole-close control signals S11*a*, S11*b* and S11*c* to the contacts 2*a*, 2*b* and 2*c*, respectively, at timings Ta-T10, Tb-T10 and Tc-T10 that precede the target pole-close timings Ta, Tb and Tc by the estimated pole-close time interval T10. By this operation, the contacts 2*a*, 2*b* and 2*c* are closed at the target pole-close timings Ta, Tb, and Tc, respectively.

Figure 2:
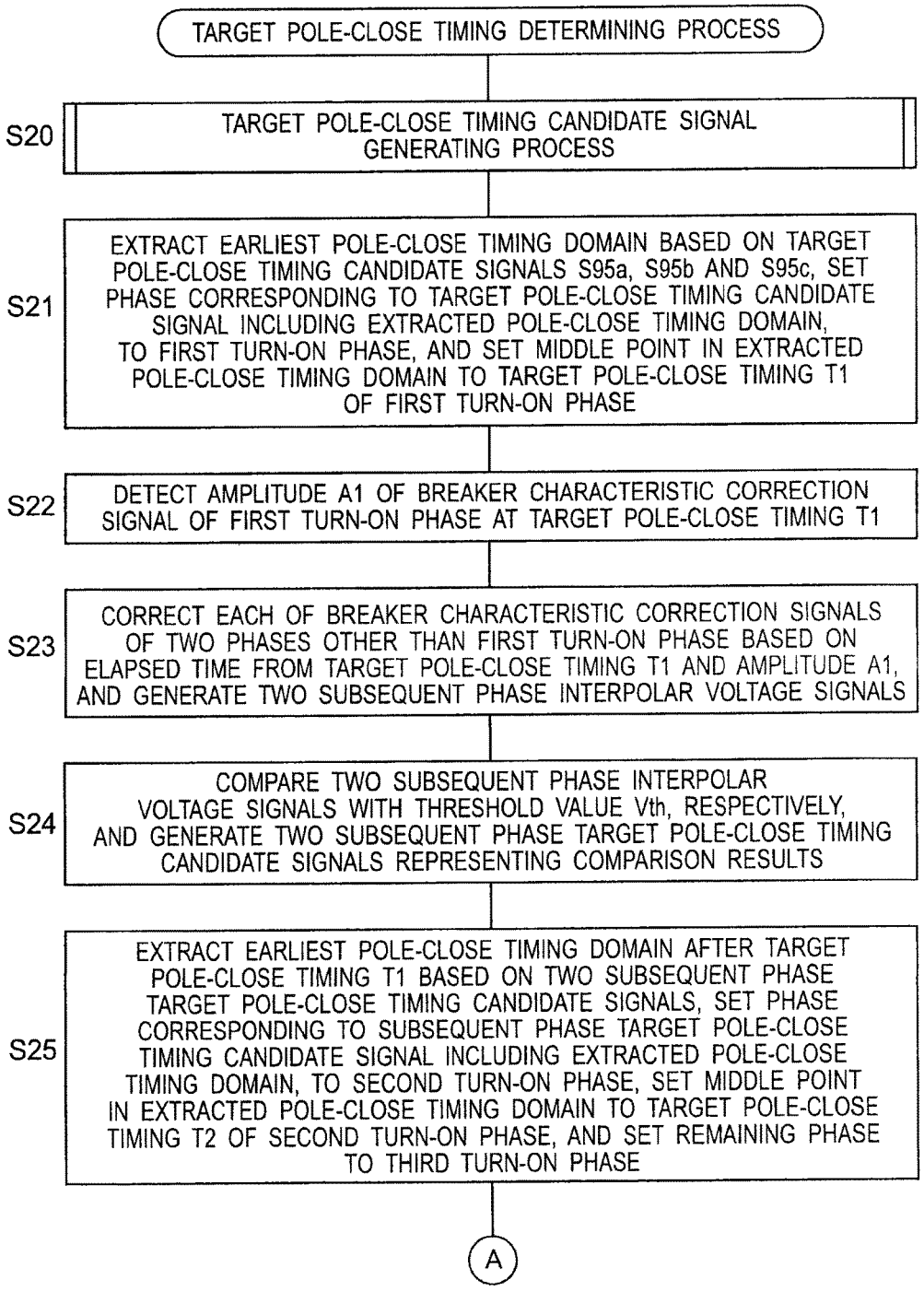
FIG. 2 is a flow chart showing a first portion of a target pole-close timing determining process executed by a target pole-close timing determining unit 9 of FIG. 1.
Figure 3:
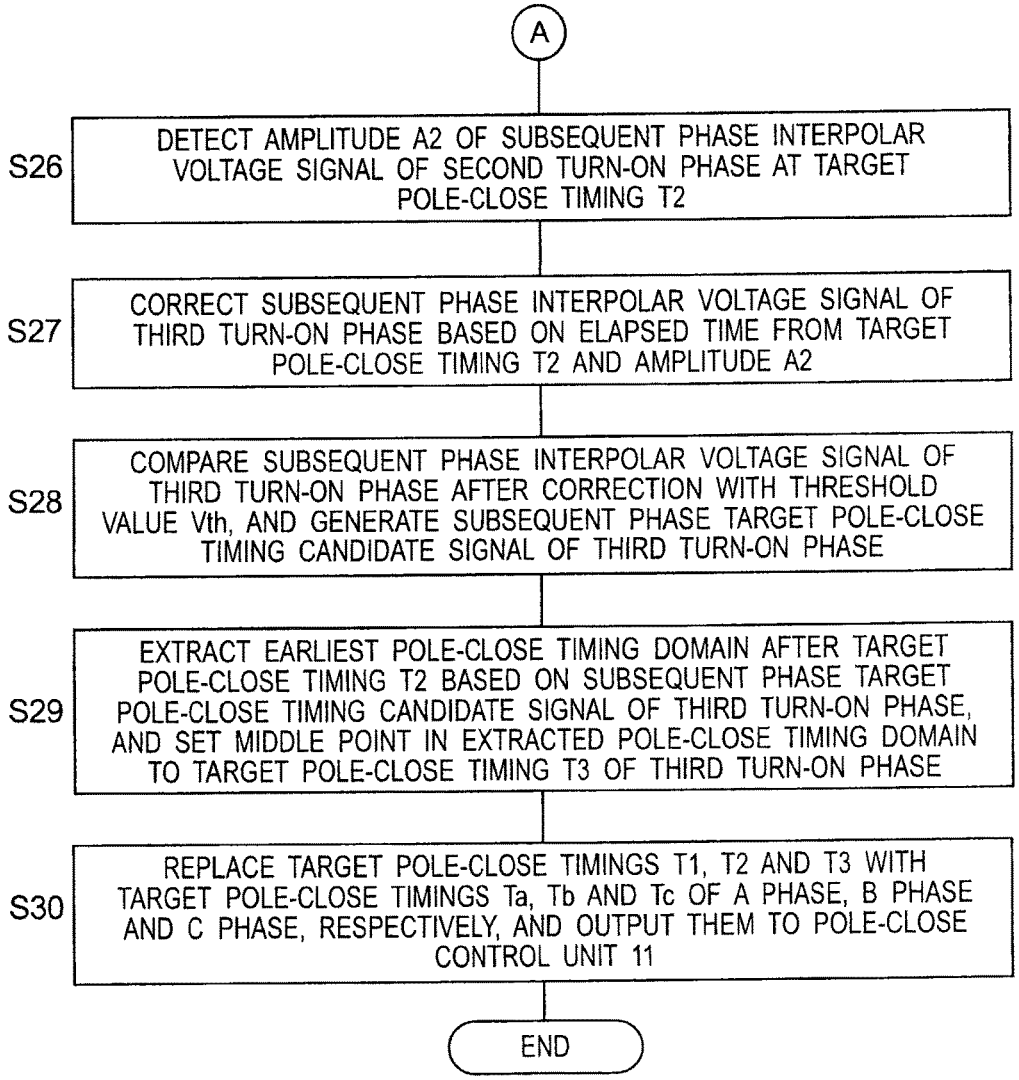
FIG. 3 is a flow chart showing a second portion of the target pole-close timing determining process executed by the target pole-close timing determining unit 9 of FIG. 1.
Figure 4:
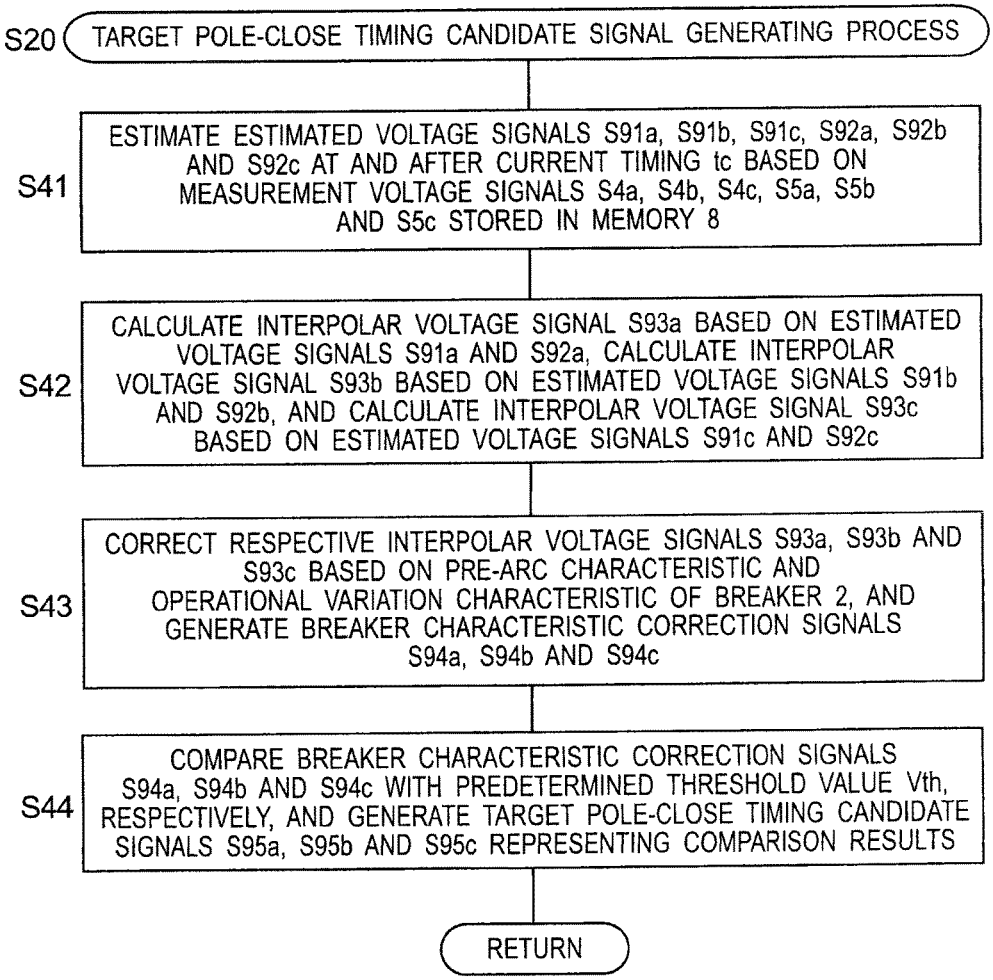
FIG. 4 is a flow chart showing a target pole-close timing candidate signal generating process executed in step S20 of FIG. 2.

FIG. 2 is a flow chart showing a first portion of a target pole-close timing determining process executed by the target pole-close timing determining unit 9 of FIG. 1, and FIG. 3 is a flow chart showing a second portion of the target pole-close timing determining process executed by the target pole-close timing determining unit 9 of FIG. 1. Referring to FIG. 2, first of all, the target pole-close timing determining unit 9 executes a target pole-close timing candidate signal generating process in step S20. FIG. 4 is a flow chart showing a target pole-close timing candidate signal generating process executed in step S20 of FIG. 2.

In step S41 of FIG. 4, the target pole-close timing determining unit 9 estimates estimated voltage signals S91*a*, S91*b*, S91*c*, S92*a*, S92*b* and S92*c* at and after a current time tc after a reception timing tf (current interruption timing) of a fault detection signal Sf based on the measurement voltage signals S4*a*, S4*b*, S4*c*, S5*a*, S5*b* and S5*c* stored in the memory 8.

One example of the calculation method of the estimated voltage signal S91*a* in step S41 is described. The target pole-close timing determining unit 9 calculates an average value of a plurality of zero timing interval of the measurement voltage signal S4*a*, and estimates the frequency of the estimated voltage signal S91*a* by multiplying the reciprocal of the average value of this zero timing interval by ½ times. Moreover, the target pole-close timing determining unit 9 stores the newest timing of zero points when the level of the measurement voltage signal S4*a* changes from negative to positive as timing t0 when the phase is zero degrees into the memory 8, and stores the newest timing of zero points when the level of the measurement voltage signal S4*a* changes from positive to negative as timing t180 when the phase is 180 degrees into the memory 8. Further, the target pole-close timing determining unit 9 estimates the amplitude of the estimated voltage signal S91*a* by calculating average values of the absolute value of the maximum value and the absolute value of the minimum value of the measurement voltage signal S4*a*. Then, the target pole-close timing determining unit 9 approximates the estimated voltage signal S91*a* to (calculated amplitude)×sin(2π×calculated frequency×t0).

The target pole-close timing determining unit 9 estimates the estimated voltage signals S91*b*, S91*c*, S92*a*, S92*b* and S92*c* based on the measurement voltage signals S4*b*, S4*c*, S5*a*, S5*b* and S5*c*, respectively, in a manner similar to that of the estimated voltage signal S91*a*. It is acceptable to estimate the estimated voltage signals S91*a*, S91*b*, S91*c*, S92*a*, S92*b* and S92*c* as 50 Hz or 60 Hz according to the system condition. Moreover, it is acceptable to calculate the effective value of the amplitude by periodically integrating the measurement voltage signals S4*b*, S4*c*, S5*a*, S5*b* and S5*c* and estimate the amplitude of the estimated voltage signals S91*a*, S91*b*, S91*c*, S92*a*, S92*b* and S92*c* by multiplying the calculated effective value by $\sqrt{2}$ times. Further, it is acceptable to estimate the estimated voltage signals S91*a*, S91*b*, S91*c*, S92*a*, S92*b* and S92*c* by using the Prony method (See, for example, the Patent Document 3) to directly calculate the frequencies, amplitudes, phases and the attenuation rates of the estimated voltage signals S91*a*, S91*b*, S91*c*, S92*a*, S92*b* and S92*c* by matrix operation.

Referring back to FIG. 4, in step S42 after step S41, the target pole-close timing determining unit 9 calculates the interpolar voltage signal S93*a* based on the estimated voltage signals S91*a* and S92*a*, calculates the interpolar voltage signal S93*b* based on the estimated voltage signals S91*b* and S92*b*, and calculates the interpolar voltage signal S93*c* based on the estimated voltage signals S91*c* and S92*c*. In concrete, the target pole-close timing determining unit 9 calculates an absolute value signal of a signal of a difference between the estimated voltage signals S91*a* and S92*a* as the interpolar voltage signal S93*a*. Moreover, the target pole-close timing determining unit 9 calculates the interpolar voltage signals S93*b* and S93*c*, in a manner similar to that of the interpolar voltage signal S93*a*.

Figure 5:
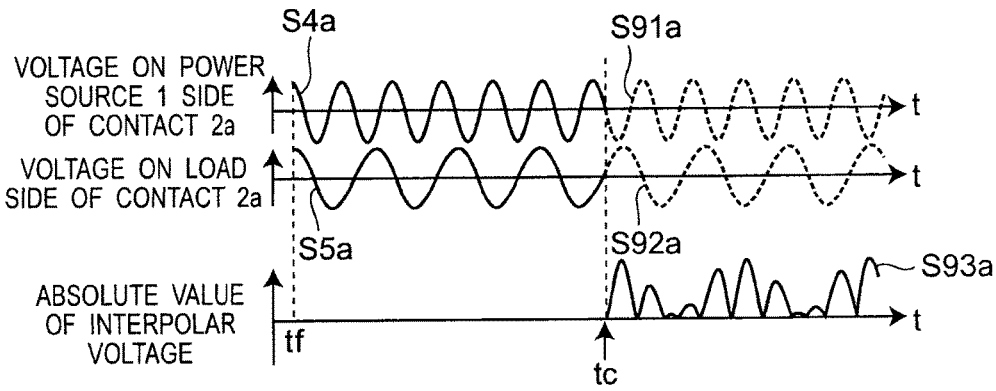
FIG. 5 is a graph showing one example of estimated voltage signals S91*a* and S92*a* calculated in step S41 of FIG. 4 and an interpolar voltage signal S93*a* estimated in step S42.

FIG. 5 is a graph showing one example of the estimated voltage signals S91*a* and S92*a* calculated in step S41 of FIG. 4 and the interpolar voltage signal S93*a* estimated in step S42. As shown in FIG. 5, the interpolar voltage signal S93*a* at and after the current time tc is calculated based on the measurement voltage signals S4*a* and S5*a*.

Referring back to FIG. 4, in step S43 after step S42, the target pole-close timing determining unit 9 corrects the respective interpolar voltage signals S93*a*, S93*b* and S93*c* based on the pre-arc characteristic and the operational variation characteristic of the breaker 2, and generates breaker characteristic correction signals S94*a*, S94*b* and S94*c*.

Figure 6:
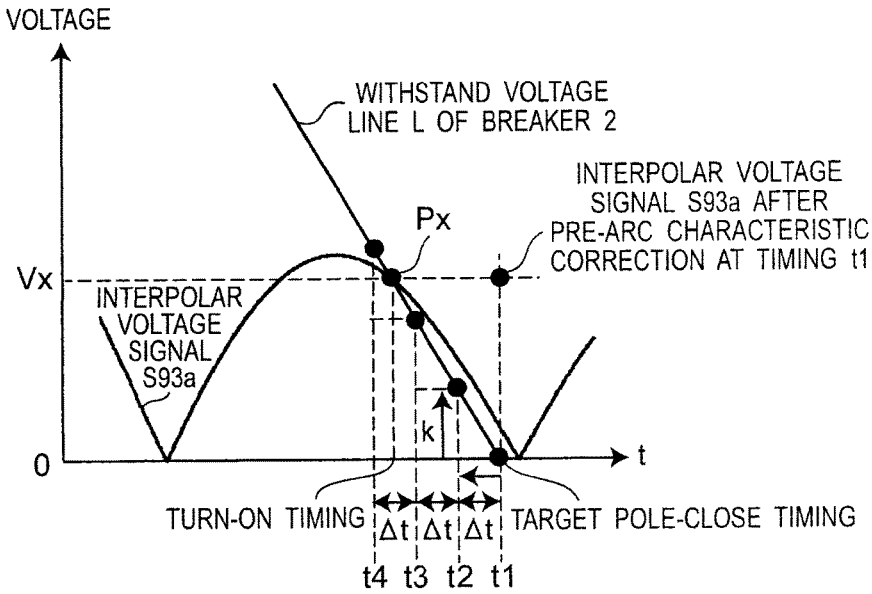
FIG. 6 is a graph for explaining a method of correcting the interpolar voltage signal S93*a* based on the pre-arc characteristic of a contact 2*a* in step S43 of FIG. 4.

FIG. 6 is a graph for explaining a method of correcting the interpolar voltage signal S93*a* based on the pre-arc characteristic of the contact 2*a* in step S43 of FIG. 4. In general, the contact of the breaker is mechanically brought in contact after a lapse of a mechanical operation time interval after a pole-close control signal for closing the contact is inputted. The timing when the contact is mechanically brought in contact is called "a pole-close", and the mechanical operation time interval is called "a pole-close time interval". Moreover, it is known that the main circuit current starts flowing in the main circuit between the contact and the power source due to advance discharge before the pole-close. This advance discharge is called "a pre-arc", and the timing when the main circuit current starts flowing is called "turn-on" or "turning-on". In this case, the turn-on timing depends on an absolute value of an interpolar voltage applied across the poles of the contact. In the present embodiment and the following embodiments, the characteristic at the timing when the contact is turned on is called "a pre-arc characteristic". The pre-arc characteristic is substantially identical between breakers of the same type, and the pre-arc characteristic is substantially identical also between contacts of a breaker.

In FIG. 6, a withstand voltage line L represents the withstand voltage value of the contact 2*a* when the contact 2*a* is closed at the target pole-close timing t1. The magnitude of the inclination of the withstand voltage line L is indicated as k. When the absolute value of the interpolar voltage is smaller than the withstand voltage at the contact 2*a*, the contact 2*a* is not turned on. At a turn-on point Px that is the intersection of the withstand voltage line L and the absolute value of the interpolar voltage of the contact 2*a*, the withstand voltage value of the contact 2*a* becomes equal to the absolute value of the interpolar voltage. Therefore, a pre-arc is generated and the contact 2*a* is turned on. The most appropriate turn-on timing is the timing when the absolute value of the interpolar voltage at the turn-on timing becomes the lowest, and therefore, it is required to determine the target pole-close timing in consideration of the pre-arc characteristic described above.

A method of correcting the interpolar voltage signal S93*a* at the target pole-close timing t1 of FIG. 6 based on the pre-arc characteristic of the breaker 2 is described. Referring to FIG. 6, tracking back to the timing from the target pole-close timing t1 by each one sampling interval Δt, the value of the withstand voltage line L is compared with the value of interpolar voltage signal S93*a* at each of the timings t2, t3 and t4. Then, by interpolating the value of the interpolar voltage signal S93*a* at the timing t4 when the value of the withstand voltage line L exceeds the value of the interpolar voltage signal S93*a* and the value of the interpolar voltage signal S93*a* at the preceding timing t3, a voltage value Vx of the interpolar voltage signal S93*a* at the turn-on point Px is calculated. The voltage value Vx is an absolute value of the interpolar voltage between the contacts 2*a* at the turn-on timing when the contact 2*a* is closed at the target pole-close timing t1. In the present embodiment, the voltage value Vx is adopted as a value of the interpolar voltage signal S93*a* after the pre-arc characteristic correction at the timing t1. By executing the aforementioned processes at every sampling timing, the interpolar voltage signal S93*a* after the pre-arc characteristic correction is calculated. The target pole-close timing determining unit 9 corrects the interpolar voltage signals S93*b* and S93*c* based on the pre-arc characteristic of the breaker 2 in a manner similar to that of the interpolar voltage signal S93*a*.

Next, a method of correcting the interpolar voltage signals S93*a*, S93*b* and S93*c* based on the operational variation characteristic of the breaker 2 in step S43 of FIG. 4 is described. The contacts 2*a*, 2*b* and 2*c* of the breaker 2 have inherent mechanical operational variations in the breaker 2. Moreover, the contacts 2*a*, 2*b* and 2*c* have an identical operational variation characteristic. In the present embodiment, the operational variation time interval ±E (milliseconds) of the breaker 2 is preliminarily measured. Then, a maximum value filter of a width of 2E (milliseconds) is applied to the interpolar voltage signals S93*a*, S93*b* and S93*c* after the pre-arc characteristic correction. In concrete, a time interval window of 2E milliseconds is set before and after the sampling timing at each sampling timing, and the maximum values of the interpolar voltage signals S93*a*, S93*b* and S93*c* after the pre-arc characteristic correction in the time interval window is extracted, and breaker characteristic correction signals S94*a*, S94*b* and S94*c* are generated.

Figure 7:
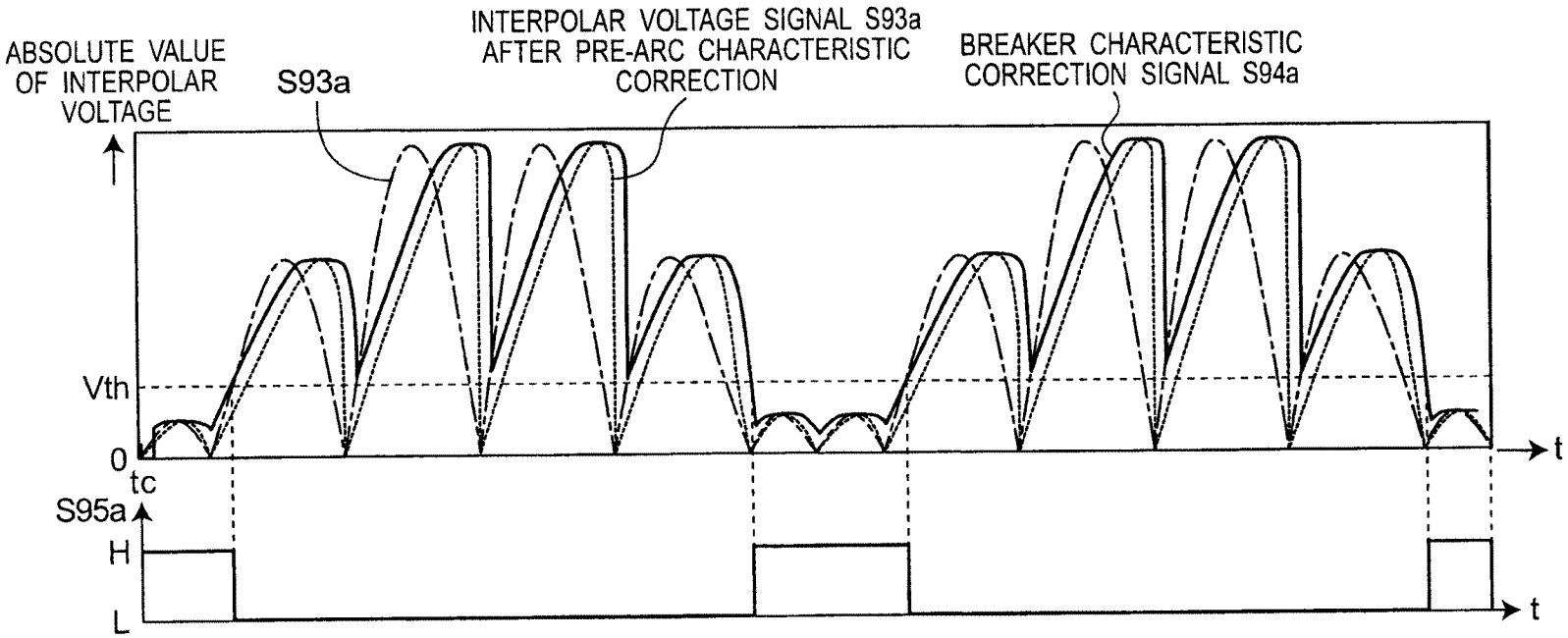
FIG. 7 is a graph showing one example of a breaker characteristic correction signal S94*a* generated in step S43 of FIG. 4 and a target pole-close timing candidate signal S95*a* generated in step S44.

FIG. 7 is a graph showing one example of the breaker characteristic correction signal S94*a* generated in step S43 of FIG. 4 and the target pole-close timing candidate signal S95*a* generated in step S44. As shown in FIG. 7, the target pole-close timing determining unit 9 corrects the interpolar voltage signal S93*a* based on the pre-arc characteristic of the breaker 2, and thereafter further corrects the signal based on the operational variation characteristic of the breaker 2 to calculate the breaker characteristic correction signal S94*a*.

Referring back to FIG. 4, in step S44 after step S43, the target pole-close timing determining unit 9 compares the breaker characteristic correction signals S94*a*, S94*b* and S94*c* with a predetermined threshold value Vth, respectively, and generates the target pole-close timing candidate signals S95*a*, S95*b* and S95*c* representing the comparison results, and the program flow returns to the target timing determining process of FIG. 2. In concrete, the target pole-close timing determining unit 9 generates a low-level target pole-close timing candidate signal S95*a* when the breaker characteristic correction signal S94*a* is larger than the threshold value Vth or generates a high-level target pole-close timing candidate signal S95*a* when the target pole-close timing candidate signal S95*a* is equal to or smaller than the threshold value Vth. Moreover, the target pole-close timing determining unit 9 generates the target pole-close timing candidate signals S95*b* and S95*c* in a manner similar to that of the target pole-close timing candidate signal S95*a*.

Figure 8:
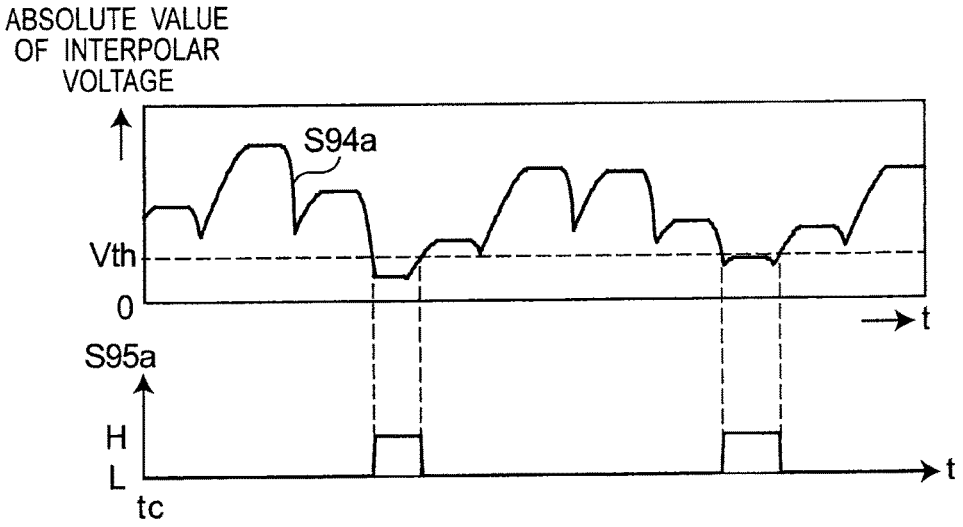
FIG. 8 is a graph showing one example of the breaker characteristic correction signal S94*a* generated in step S43 of FIG. 4 and the target pole-close timing candidate signal S95*a* generated in step S44, when a ground fault occurs at the power transmission line 3*b* of FIG. 1.
Figure 9:
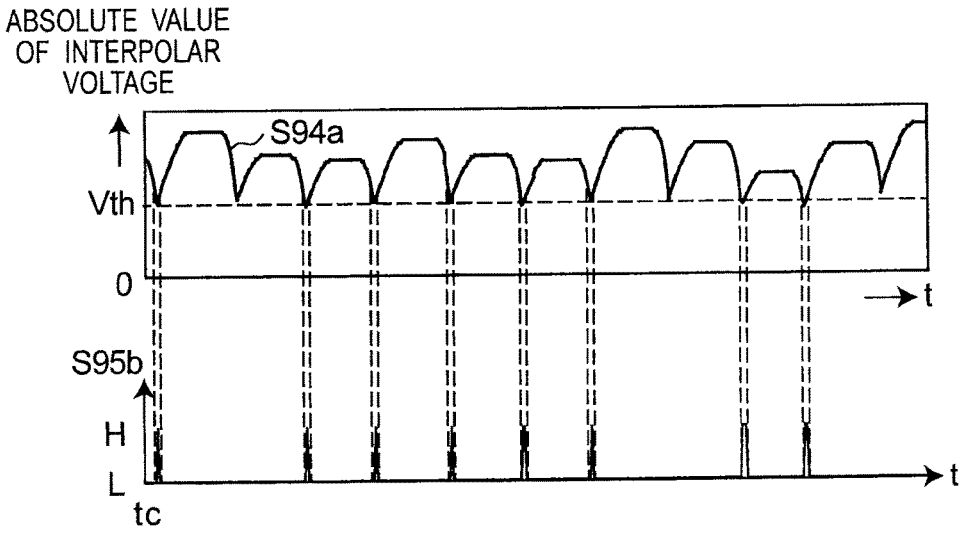
FIG. 9 is a graph showing one example of a breaker characteristic correction signal S94*b* generated in step S43 of FIG. 4 and a target pole-close timing candidate signal S95*b* generated in step S44, when a ground fault occurs at the power transmission line 3*b* of FIG. 1.
Figure 10:
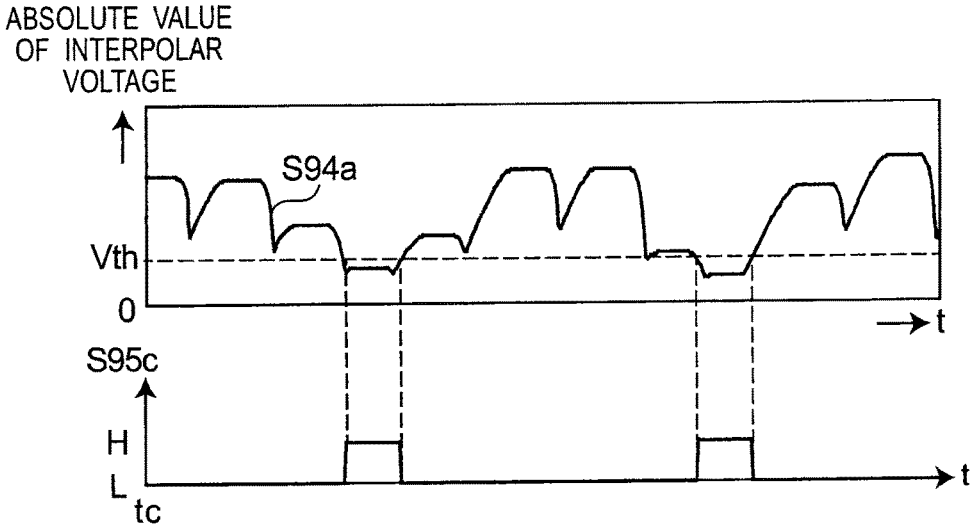
FIG. 10 is a graph showing one example of a breaker characteristic correction signal S94*c* generated in step S43 of FIG. 4 and a target pole-close timing candidate signal S95*c* generated in step S44, when a ground fault occurs at a power transmission line 3*b* of FIG. 1.

FIG. 8 is a graph showing one example of the breaker characteristic correction signal S94*a* generated in step S43 of FIG. 4 and the target pole-close timing candidate signal S95*a* generated in step S44, when a ground fault occurs in the power transmission line 3*b* of FIG. 1. Moreover, FIG. 9 is a graph showing one example of the breaker characteristic correction signal S94*b* generated in step S43 of FIG. 4 and the target pole-close timing candidate signal S95*b* generated in step S44, when a ground fault occurs in the power transmission line 3*b* of FIG. 1. Further, FIG. 10 is a graph showing one example of the breaker characteristic correction signal S94*c* generated in step S43 of FIG. 4 and the target pole-close timing candidate signal S95*c* generated in step S44, when a ground fault occurs in the power transmission line 3*b* of FIG. 1. Hereinafter, a time interval for which the voltage level is high level in each of the target pole-close timing candidate signals S95*a*, S95*b* and S95*c* is referred to as a pole-close timing domain.

Referring back to FIG. 2, in step S21 after step S20, the target pole-close timing determining unit 9 extracts the earliest pole-close timing domain based on the target pole-close timing candidate signals S95*a*, S95*b* and S95*c*, sets the phase corresponding to the target pole-close timing candidate signal including the extracted pole-close timing domain to the first turn-on phase, and sets the middle point in the extracted pole-close timing domain to the target pole-close timing T1 of the first turn-on phase. In this case, the first turn-on phase is the phase first turned on among the A phase, the B phase and the C phase. Next, the target pole-close timing determining unit 9 detects, in step S22, the amplitude A1 of the breaker characteristic correction signal of the first turn-on phase at the target pole-close timing T1. The amplitude A1 is an absolute value of the interpolar voltage at the timing of turning on the first turn-on phase.

Further, in step S23, the target pole-close timing determining unit 9 corrects each of the breaker characteristic correction signals of two phases other than the first turn-on phase based on an elapsed time from the target pole-close timing T1 and the amplitude A1, and generates two subsequent phase interpolar voltage signals. The inventor and others of the present application obtained a new knowledge that an absolute value of an interpolar voltage of the subsequent turn-on phase increased in accordance with an increase in the absolute value of the interpolar voltage at the timing of turning on the preceding turn-on phase. Further, the inventor and others of the present application obtained a new knowledge that an absolute value of the interpolar voltage of the subsequent turn-on phase increased in accordance with an increase in the elapsed time from the target pole-close timing of the preceding turn-on phase. This is because the frequency and the phase of the load side voltage of the subsequent phase vary in accordance with the turning-on of the preceding turn-on phase.

Figure 11:
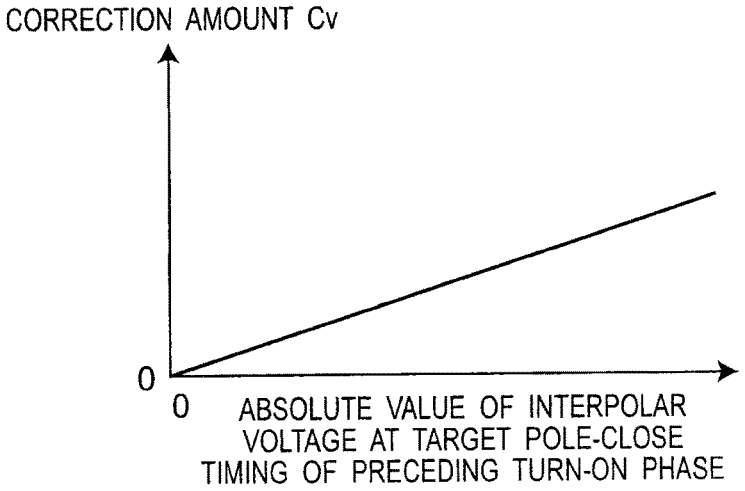
FIG. 11 is a graph showing a relation between an absolute value of an interpolar voltage at a target pole-close timing of a preceding turn-on phase and a correction amount Cv of an interpolar voltage absolute value of a subsequent turn-on phase used in step S23 of FIG. 2.

FIG. 11 is a graph showing a relation between an absolute value of the interpolar voltage at the target pole-close timing of the preceding turn-on phase used in step S23 of FIG. 2 and the correction amount Cv of the interpolar voltage absolute value of the subsequent turn-on phase. In this case, the absolute value of the interpolar voltage at the target pole-close timing of the preceding turn-on phase is the absolute value of the interpolar voltage at the timing of turning on the preceding turn-on phase. In FIG. 11, the correction amount Cv is expressed by the following equation:

$$Cv=\alpha v\times(\text{absolute value of interpolar voltage at target pole-close timing of preceding turn-on phase})$$

In the present embodiment, an inclination $\alpha v$ of the correction amount Cv is preliminarily determined by experiments or simulations. For example, when the inclination $\alpha v$ is 1 and the absolute value of the interpolar voltage at the target pole-close timing of the preceding turn-on phase is 0.3 (PU), the correction amount Cv becomes 0.3 (PU).

Figure 12:
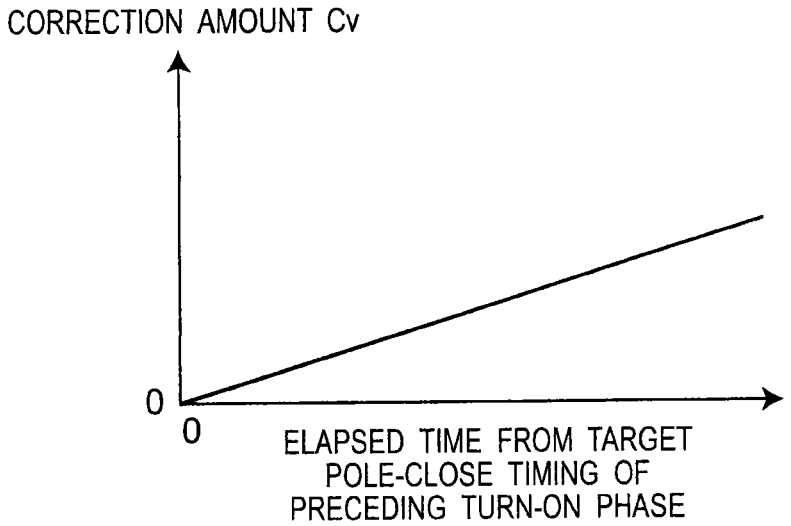
FIG. 12 is a graph showing a relation between an elapsed time from the target pole-close timing of the preceding turn-on phase and a correction amount Ct of the interpolar voltage absolute value of the subsequent turn-on phase used in step S23 of FIG. 2.

FIG. 12 is a graph showing a relation between the elapsed time from the target pole-close timing of the preceding turn-on phase used in step S23 of FIG. 2 and the correction amount Ct of the interpolar voltage absolute value of the subsequent turn-on phase. In FIG. 12, the correction amount Ct is expressed by the following equation.

$$Ct=\alpha t\times(\text{elapsed time from target pole-close timing of preceding turn-on phase})$$

In the present embodiment, the inclination at of the correction amount Ct is preliminarily determined by experiments or simulations. For example, when Ct is 0.01 (PU/milliseconds) and the elapsed time from the target pole-close timing of the preceding turn-on phase is 10 (milliseconds), the correction amount Ct becomes 0.1 (PU).

In step S23 of FIG. 2, the target pole-close timing determining unit 9 corrects each breaker characteristic correction signal by adding the correction amount Ct that depends on the elapsed time from the target pole-close timing T1 and the correction amount Cv corresponding to the amplitude A1 to each of the breaker characteristic correction signals of the two phases other than the first turn-on phase, and generates two subsequent phase interpolar voltage signals.

Next, in step S24 of FIG. 2, the target pole-close timing determining unit 9 compares the two subsequent phase interpolar voltage signals with the threshold value Vth, respectively, and generates two subsequent phase target pole-close timing candidate signals. The process of step S24 is similar to the process of step S44. Further, in step S25, the target pole-close timing determining unit 9 extracts the earliest pole-close timing domain after the target pole-close timing T1 based on two subsequent phase target pole-close timing candidate signals, sets the phase corresponding to the subsequent phase target pole-close timing candidate signal including the extracted pole-close timing domain to the second turn-on phase, sets the middle point in the extracted pole-close timing domain to the target pole-close timing T2 of the second turn-on phase, and sets the remaining phase to the third turn-on phase. When the earliest pole-close timing domain after the target pole-close timing T1 cannot be extracted based on two subsequent phase target pole-close timing candidate signals in step S25, the program flow returns to step S21 to extract the second earliest pole-close timing domain based on the target pole-close timing candidate signals S95*a*, S95*b* and S95*c*, and then execute the processes after step S21.

In step S26 of FIG. 3 after step S25, the target pole-close timing determining unit 9 detects the amplitude A2 of the subsequent phase interpolar voltage signal of the second turn-on phase at the target pole-close timing T2. Next, in step S27, the target pole-close timing determining unit 9 corrects the subsequent phase interpolar voltage signal of the third turn-on phase based on the elapsed time from the target pole-close timing T2 and the amplitude A2. The process of step S27 is similar to the process of step S23. In step S28 after step S27, the target pole-close timing determining unit 9 compares the subsequent phase interpolar voltage signal of the third turn-on phase after correction with the threshold value Vth, and generates the subsequent phase target pole-close timing candidate signal of the third turn-on phase.

Further, in step S29, the target pole-close timing determining unit 9 extracts the earliest pole-close timing domain after the target pole-close timing T2 based on the subsequent phase target pole-close timing candidate signal of the third turn-on phase, and sets the middle point in the extracted pole-close timing domain to the target pole-close timing T3 of the third turn-on phase. When the earliest pole-close timing domain after the target pole-close timing T2 cannot be extracted based on the subsequent phase target pole-close timing candidate signal of the third turn-on phase by the target pole-close timing determining unit 9 in step S29, the program flow returns to step S21 to extract the second earliest pole-close timing domain based on the target pole-close timing candidate signals S95*a*, S95*b* and S95*c*, and execute the processes after step S21. Finally, in step S30, the target pole-close timing determining unit 9 replaces the target pole-close timings T1, T2 and T3 with the target pole-close timings Ta, Tb and Tc of the A phase, the B phase and the C phase, respectively, and outputs the replaced timings to the pole-close control unit 11, and the target pole-close timing determining process is ended.

Therefore, when the first turn-on phase is the A phase and the second turn-on phase is the B phase, the target pole-close timing determining unit 9 determines the target pole-close timings Ta and Tb as follows. First of all, the target pole-close timing determining unit 9 estimates the absolute value (estimated voltage signal S91*a*) of the interpolar voltage of the contact 2*a* at and after the current time tc by using the measurement voltage signals S4*a* and S5*a*, and estimates the absolute value (estimated voltage signal S91*b*) of the interpolar voltage of the contact 2*b* at and after the current time tc by using the measurement voltage signals S4*b* and S5*b*. Then, the target pole-close timing Ta of the contact 2*a* is set to a timing when the absolute value (breaker characteristic correction signal S94*a*) of the interpolar voltage of the contact 2*a* is equal to or smaller than the threshold value Vth. Further, the absolute value (breaker characteristic correction signal S94*b*) of the interpolar voltage of the contact 2*b* is corrected based on the absolute value A1 of the interpolar voltage of the contact 2*a* at the target pole-close timing Ta and the elapsed time from the target pole-close timing Ta, and sets the target pole-close timing Tb of the contact 2*b* to a timing when the absolute value (subsequent phase interpolar voltage signal) of the corrected interpolar voltage of the contact 2*b* is equal to or smaller than the threshold value Vth.

In this case, the target pole-close timing determining unit 9 sets the correction amount Cv based on the absolute value (breaker characteristic correction signal. S94*a*) of the interpolar voltage of the contact 2*a* at the target pole-close timing Ta, sets the correction amount Ct based on the elapsed time from the target pole-close timing Ta, and corrects the absolute value of the interpolar voltage of the contact 2*b* by adding the correction amounts Cv and Ct to the absolute value (breaker characteristic correction signal S94*a*) of the interpolar voltage of the contact 2*b*. Moreover, the correction amount Cv is set so as to increase in accordance with an increase in the absolute value (breaker characteristic correction signal S94*a*) of the interpolar voltage of the contact 2*a* at the target pole-close timing Ta. Further, the correction amount Ct is set so as to increase in accordance with an increase in the elapsed time from the target pole-close timing Ta.

Figure 13:
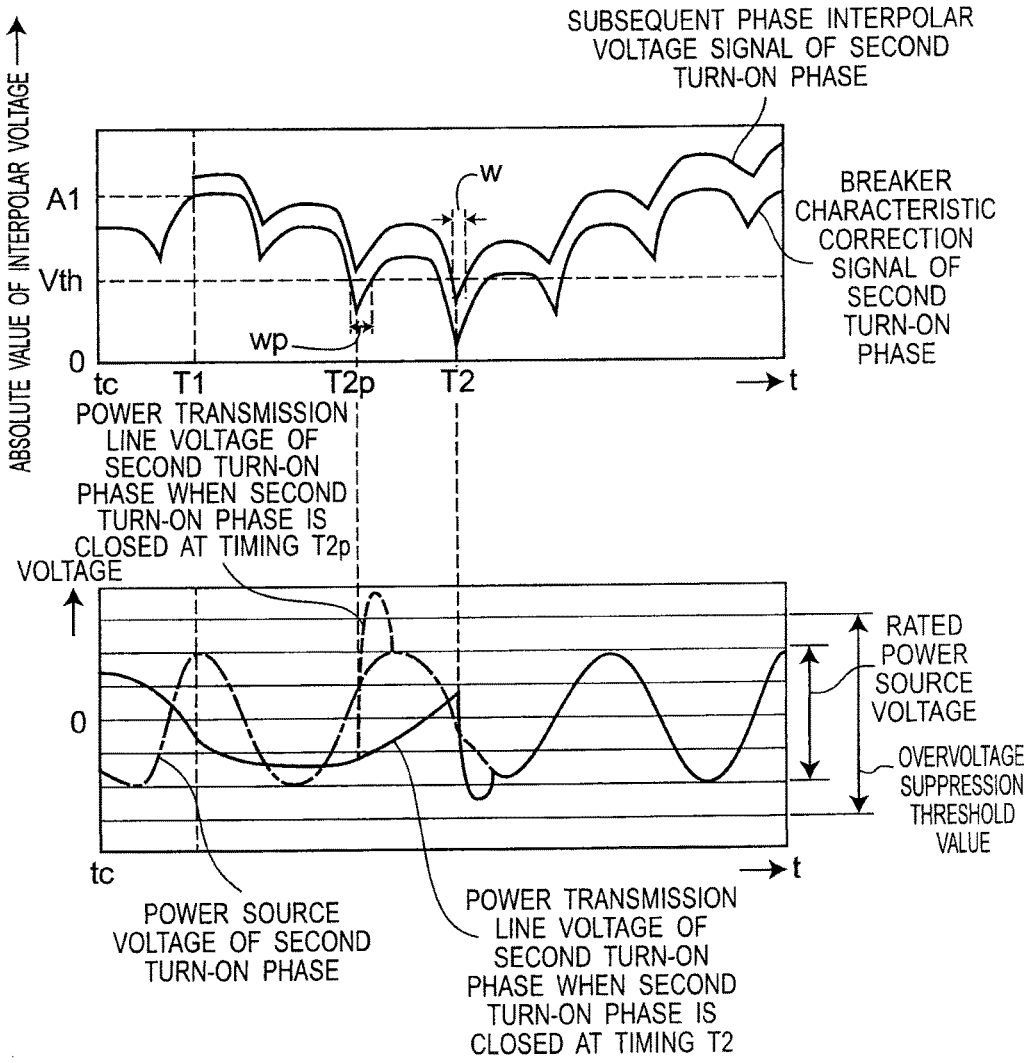
FIG. 13 is a graph showing one example of a breaker characteristic correction signal of the second turn-on phase and a subsequent phase interpolar voltage signal obtained by executing the target pole-close timing determining process of FIGS. 2 and 3, and a graph showing a power transmission line voltage of the second turn-on phase when the second turn-on phase is turned on at a target pole-close timing T2, and the power transmission line voltage of the second turn-on phase when the second turn-on phase is turned on at a target pole-close timing T2*p;*

FIG. 13 is a graph showing one example of the breaker characteristic correction signal of the second turn-on phase and the subsequent phase interpolar voltage signal obtained by executing the target pole-close timing determining process of FIGS. 2 and 3, and a graph showing a power transmission line voltage of the second turn-on phase when the second turn-on phase is turned on at the target pole-close timing T2 and the power transmission line voltage of the second turn-on phase when the second turn-on phase is turned on at the target pole-close timing T2*p*.

The prior art power switching control apparatus adopted, for example, the middle point of an interval Wp for which the level of the breaker characteristic correction signal of the second turn-on phase of FIG. 13 initially becomes equal to or smaller than the threshold value Vth to the target pole-close timing T2*p* of the second turn-on phase. On the other hand, according to the present embodiment, the target pole-close timing determining unit 9 corrects, in step S23 of FIG. 2, the breaker characteristic correction signal of the second turn-on phase of FIG. 13 based on the elapsed time from the target pole-close timing T1 and the amplitude A1, generates the subsequent phase interpolar voltage signal of the second turn-on phase, and adopts the middle point of an interval W for which the level of the subsequent correction signal initially becomes equal to or smaller than the threshold value Vth to the target pole-close timing T2 of the second turn-on phase.

Referring to FIG. 13, the minimum value within the interval Wp of the breaker characteristic correction signal of the second turn-on phase becomes larger than the threshold value Vth in the subsequent phase interpolar voltage signal of the second turn-on phase. Therefore, if the second turn-on phase is closed at the target pole-close timing T2*p*, an overvoltage is generated in accordance with an increase in the absolute value of the interpolar voltage of the second turn-on phase accompanying the turning-on of the first turn-on phase. In this case, a power transmission line voltage larger than a predetermined overvoltage suppression threshold value is referred to as an overvoltage. The overvoltage suppression threshold value is smaller than the rated power source voltage. According to the present embodiment, the second turn-on phase is closed at the target pole-close timing T2 when the level of the subsequent phase interpolar voltage signal becomes equal to or smaller than the threshold value Vth instead of the target pole-close timing T2*p*. Therefore, the interval of the unbalanced three-phase occurrence is made to be shorter than that of the prior art, so that pole-close can be achieved at the timing when the interpolar voltage at the turn-on timing is small, and then the overvoltage can be reliably suppressed.

In the power switching control apparatus described in the Patent Document 2, the target pole-close timing domain was narrowed when the turn-on order (or sequence) was the subsequent turn-on phase after the second turn-on phase by delaying the start timing of the target pole-close timing domain (e.g., an interval W of FIG. 13) by a predetermined delay time interval that was preliminarily set by being calculated from a predetermined maximum fluctuation amount with estimation of the fluctuation in the breaker interpolar voltage due to the turning-on of the preceding turn-on phase. Then, the subsequent turn-on phase was closed at the predetermined timing within the narrowed target pole-close timing domain. That is, the fixed maximum delay time interval was used without depending on the absolute value of the interpolar voltage at the timing of turning on the preceding turn-on phase. Accordingly, there was a possibility of losing the pole-close opportunity of the subsequent turn-on phase. Moreover, when the interval duration of the target pole-close timing domain was shorter than the aforementioned predetermined delay time interval, the target pole-close timing domain itself could not be set, and the target pole-close timing of the second turn-on phase could not be determined. In contrast to this, according to the present embodiment, the correction amount Cv of the interpolar voltage absolute value of the subsequent turn-on phase is set based on the absolute value of the interpolar voltage at the target pole-close timing of the preceding turn-on phase, and therefore, the target pole-close timing of the subsequent turn-on phase can be determined more appropriately than that of the prior art.

Further, in the power switching control apparatus described in the Patent Document 2, the fixed breaker interpolar voltage maximum fluctuation value was used without depending on the elapsed time from the target pole-close timing of the preceding turn-on phase. However, actually, when the frequency and the phase of the interpolar voltage of the subsequent phase fluctuate in accordance with the turning-on of the preceding turn-on phase, the fluctuation amount of the interpolar voltage of the subsequent turn-on phase increases in accordance with an increase in the elapsed time from the target pole-close timing of the preceding turn-on phase. Therefore, according to the power switching control apparatus described in the Patent Document 2, there is a possibility that the overvoltage and the overcurrent at the timing of turning on the subsequent turn-on phase is unable to be suppressed depending on the elapsed time from the target pole-close timing of the preceding turn-on phase. In contrast to this, according to the present embodiment, the correction amount Cv of the interpolar voltage absolute value of the subsequent turn-on phase is set based on the absolute value of the interpolar voltage at the target pole-close timing of the preceding turn-on phase. Therefore, even if the frequency and the phase of the interpolar voltage of the subsequent phase fluctuate in accordance with the pole-close of the preceding turn-on phase, the overvoltage and the overcurrent can be suppressed without depending on the elapsed time from the target pole-close timing of the preceding turn-on phase.

As described above, according to the present embodiment, the breaker characteristic correction signal including the fluctuation in the load side voltage of the subsequent turn-on phase after the pole-close of the preceding turn-on phase is corrected based on the absolute value of the interpolar voltage at the pole-close timing of the preceding turn-on phase and the elapsed time from the target pole-close timing of the preceding turn-on phase, and the target pole-close timing of the subsequent phase is determined by using the subsequent phase interpolar voltage signal after correction. Therefore, even if the voltage value and the frequency of the load side voltage of the subsequent turn-on phase fluctuate in accordance with the pole-close of the preceding turn-on phase, the overvoltage generated at the pole-close timing of the subsequent turn-on phase can be suppressed. Moreover, according to the present embodiment, the subsequent turn-on phase can be turned on at the target pole-close timing when the elapsed time from the pole-close timing of the preceding turn-on phase is small and the interpolar voltage at the pole-close timing is smaller than the threshold voltage Vth, and therefore, the overvoltage generated at the timing of turning on the power transmission line can be suppressed.

Although the middle point in the pole-close timing domain is set to the target pole-close timing in steps S21, S25 and S29 in the present embodiment, the present invention is not limited to this. For example, it is acceptable to set a timing when the absolute value of the interpolar voltage in the pole-close timing domain is minimized to the target pole-close timing. Moreover, it is acceptable to detect the minimum value equal to or smaller than the threshold value Vth in the breaker characteristic correction signal of the first turn-on phase and the subsequent phase interpolar voltage signal of the subsequent turn-on phase and set a timing that gives the detected minimum value to the target pole-close timing. In this case, at the sampling timing of each of the breaker characteristic correction signal of the first turn-on phase and the subsequent phase interpolar voltage signal of the subsequent turn-on phase, a difference value obtained by subtracting the absolute value of the interpolar voltage at the immediately preceding sampling timing from the absolute value of the interpolar voltage at the sampling timing is calculated. Then, it is proper to detect the aforementioned minimum value by detecting the timing when the calculated difference value changes from a negative value to a positive value.

Figure 14:
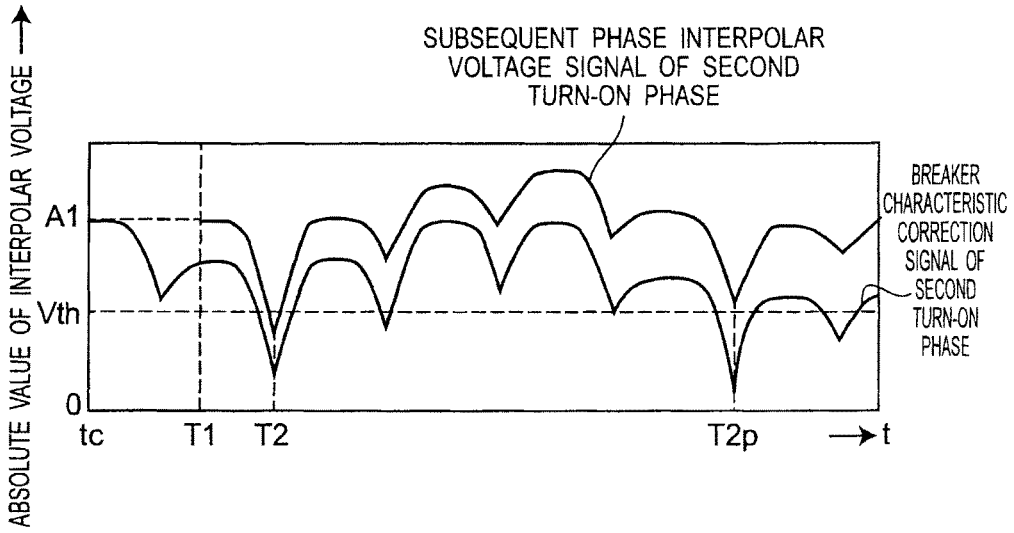
FIG. 14 is a graph showing another example of the breaker characteristic correction signal of the second turn-on phase and the subsequent phase interpolar voltage signal obtained by executing the target pole-close timing determining process of FIGS. 2 and 3.

FIG. 14 is a graph showing another example of the breaker characteristic correction signal of the second turn-on phase and the subsequent phase interpolar voltage signal obtained by executing the target pole-close timing determining process of FIGS. 2 and 3. FIG. 14 shows a target pole-close timing T2*p* of the second turn-on phase determined by the prior art power switching control apparatus that adopts the timing when the breaker characteristic correction signal is minimized to the target pole-close timing of the subsequent turn-on phase. As shown in FIG. 14, the voltage value of the subsequent phase interpolar voltage signal of the second turn-on phase at the target pole-close timing T2*p* becomes larger than the threshold value Vth, and therefore, an overvoltage is generated if the second turn-on phase is closed at the target pole-close timing T2*p*. In contrast to this, according to the present embodiment, the second turn-on phase is closed at the pole-close timing T2 when the voltage value of the subsequent phase interpolar voltage signal of the second turn-on phase is equal to or smaller than the threshold value Vth, and therefore, no overvoltage is generated.

Second Embodiment

Figure 15:
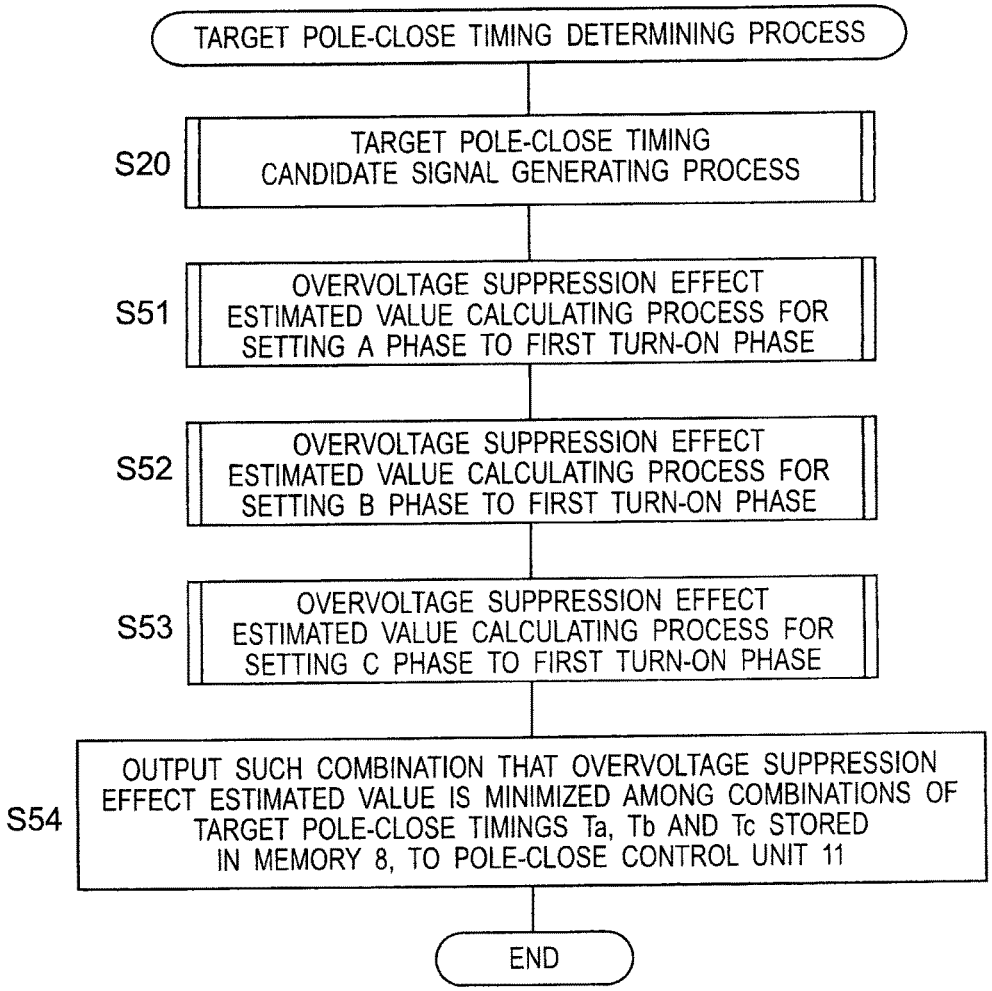
FIG. 15 is a flow chart showing a target pole-close timing determining process according to a second embodiment of the present invention.
Figure 16:
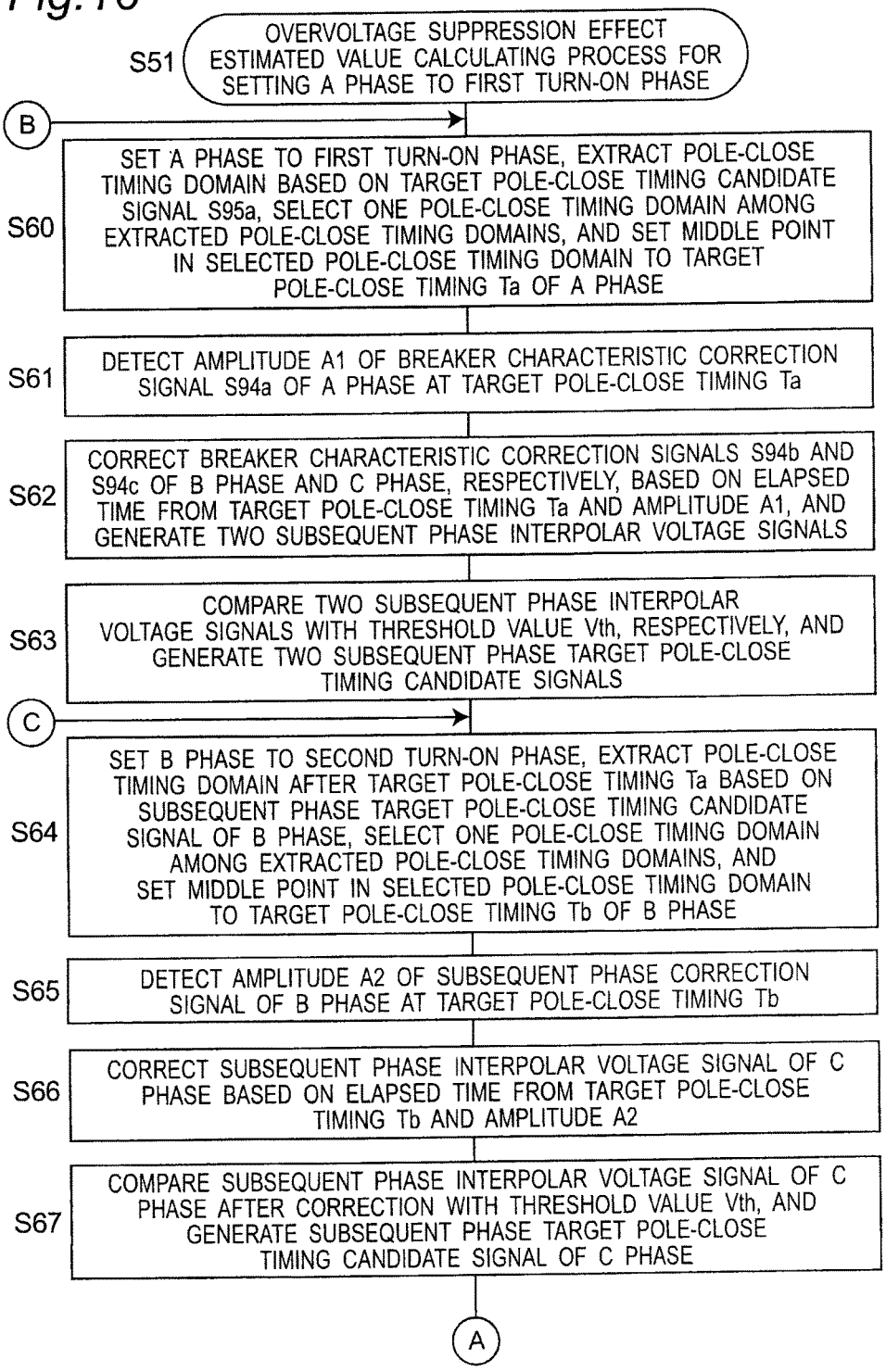
FIG. 16 is a flow chart showing a first portion of an overvoltage suppression effect estimated value calculating process for setting an A phase to the first turn-on phase executed in step S51 of FIG. 15.
Figure 17:
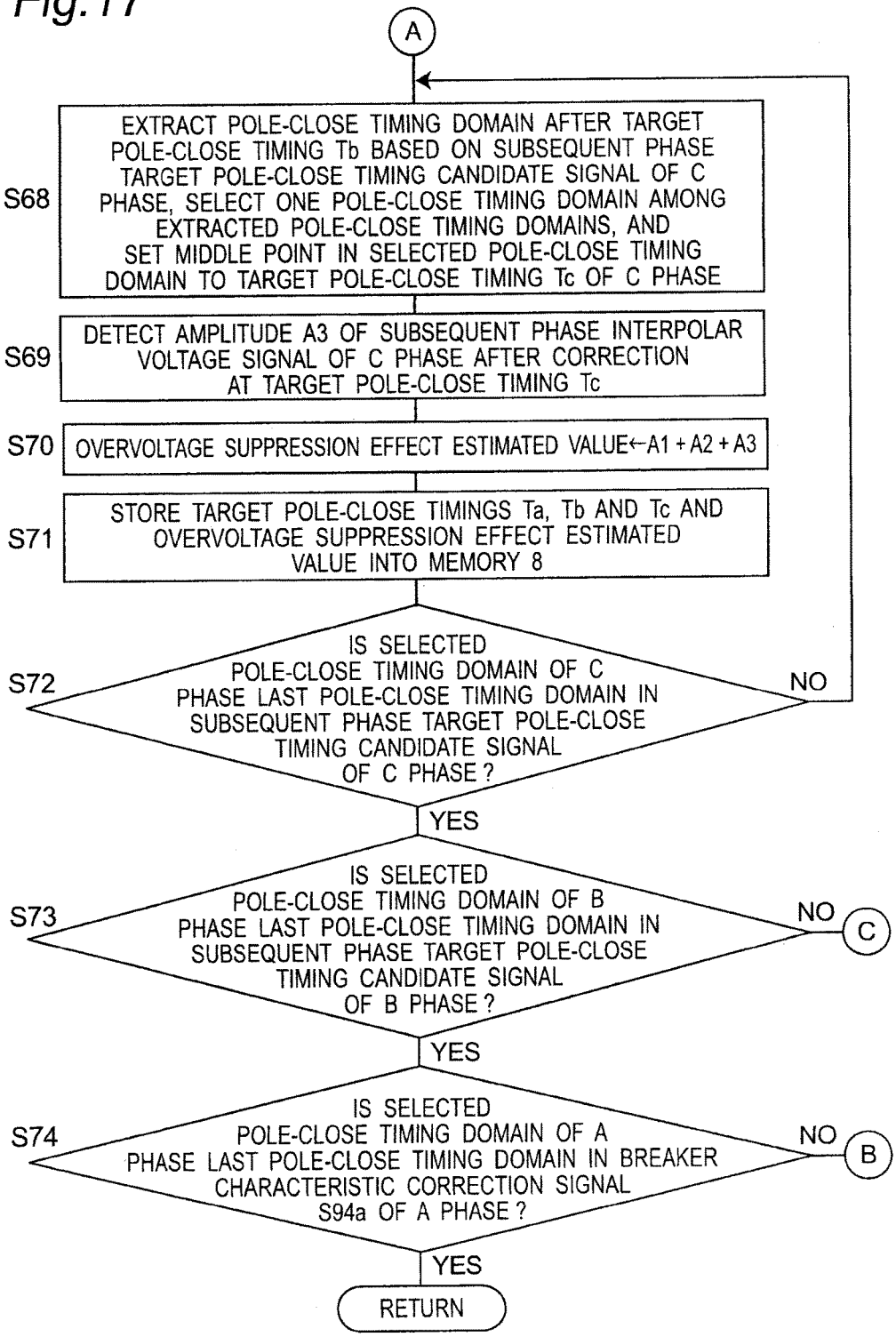
FIG. 17 is a flow chart showing a second portion of the overvoltage suppression effect estimated value calculating process for setting the A phase to the first turn-on phase executed in step S51 of FIG. 15.

FIG. 15 is a flow chart showing a target pole-close timing determining process according to a second embodiment of the present invention. Referring to FIG. 15, first of all, the target pole-close timing determining unit 9 executes in step S20 the target pole-close timing candidate signal generating process of FIG. 4. Next, in step S51, the target pole-close timing determining unit 9 executes an overvoltage suppression effect estimated value calculating process for setting the A phase to the first turn-on phase. FIG. 16 is a flow chart showing a first portion of the overvoltage suppression effect estimated value calculating process for setting the A phase to the first turn-on phase executed in step S51 of FIG. 15, and FIG. 17 is a flow chart showing a second portion of the overvoltage suppression effect estimated value calculating process for setting the A phase to the first turn-on phase executed in step S51 of FIG. 15.

In step S60 of FIG. 16, the target pole-close timing determining unit 9 sets the A phase to the first turn-on phase, extracts the pole-close timing domain based on the target pole-close timing candidate signal S95*a*, selects one pole-close timing domain among the extracted pole-close timing domains, and sets the middle point in the selected pole-close timing domain to the target pole-close timing Ta of the A phase. Next, in step S61, the target pole-close timing determining unit 9 detects the amplitude A1 of the breaker characteristic correction signal S94*a* of the A phase at the target pole-close timing Ta.

Further, in step S62, the target pole-close timing determining unit 9 corrects the breaker characteristic correction signals S94*b* and S94*c* of the B phase and the C phase, respectively, based on the elapsed time from the target pole-close timing Ta and the amplitude A1, and generates two subsequent phase interpolar voltage signals. Next, in step S63, the target pole-close timing determining unit 9 compares the two subsequent phase interpolar voltage signals with the threshold value Vth, respectively, and generates two subsequent phase target pole-close timing candidate signals. Further, in step S64, the target pole-close timing determining unit 9 sets the B phase to the second turn-on phase, extracts the pole-close timing domain after the target pole-close timing Ta based on the subsequent phase target pole-close timing candidate signal of the B phase, selects one pole-close timing domain among the extracted pole-close timing domains, and sets the middle point in the selected pole-close timing domain to the target pole-close timing Tb of the B phase. Subsequently, the target pole-close timing determining unit 9 detects, in step S65, the amplitude A2 of the subsequent phase interpolar voltage signal of the B phase at the target pole-close timing Tb, and corrects, in step S66, the subsequent phase interpolar voltage signal of the C phase based on the elapsed time from the target pole-close timing Tb and the amplitude A2.

In step S67 after step S66, the target pole-close timing determining unit 9 compares the subsequent phase interpolar voltage signal of the C phase after correction with the threshold value Vth, and generates the subsequent phase target pole-close timing candidate signal of the C phase. Next, in step S68 of FIG. 17, the target pole-close timing determining unit 9 extracts the pole-close timing domain after the target pole-close timing Tb based on the subsequent phase target pole-close timing candidate signal of the C phase, selects one pole-close timing domain among the extracted pole-close timing domains, and sets the middle point in the selected pole-close timing domain to the target pole-close timing Tc of the C phase. Further, in step S69, the target pole-close timing determining unit 9 detects the amplitude A3 of the subsequent phase interpolar voltage signal of the C phase after correction at the target pole-close timing Tc.

Next, the target pole-close timing determining unit 9 calculates in step S70 the overvoltage suppression effect estimated value that is the sum total of the amplitudes A1, A2 and A3, and in step S71, stores the target pole-close timings Ta, Tb and Tc and the overvoltage suppression effect estimated value into the memory 8. Further, it is judged in step S72 whether or not the selected pole-close timing domain of the C phase is the last pole-close timing domain in the subsequent phase target pole-close timing candidate signal of the C phase. The program flow proceeds to step S73 when the judgment of step S72 is YES, or returns to step S68 when the judgment of step S72 is NO. The target pole-close timing determining unit 9 judges in step S73 whether or not the selected pole-close timing domain of the B phase is the last pole-close timing domain in the subsequent phase target pole-close timing candidate signal of the B phase. The program flow proceeds to step S74 when the judgment of step S73 is YES or returns to step S64 when the judgment of step S73 is NO. Moreover, the target pole-close timing determining unit 9 judges in step S74 whether or not the selected pole-close timing domain of the A phase is the last pole-close timing domain in the breaker characteristic correction signal S94*a* of the A phase. The program flow returns to the target pole-close timing determining process of FIG. 15 when the judgment of S74 is YES or returns to step S60 when the judgment of step S74 is NO.

It is noted that the processes of steps S60, S64 and S68 are similar to the process of step S21 of FIG. 2. Moreover, the processes of steps S62 and S66 are similar to the process of step S23 of FIG. 2. Further, the processes of steps S63 and S67 are similar to the process of step S24 of FIG. 2. According to the overvoltage suppression effect estimated value calculating process of FIG. 16 and FIG. 17, the target pole-close timing determining unit 9 calculates the overvoltage suppression effect estimated values regarding all the turn-on orders and combinations of the target pole-close timings Ta, Tb and Tc when the A phase is the first turn-on phase, and stores the calculated overvoltage suppression effect estimated values into the memory 8.

Figure 18:
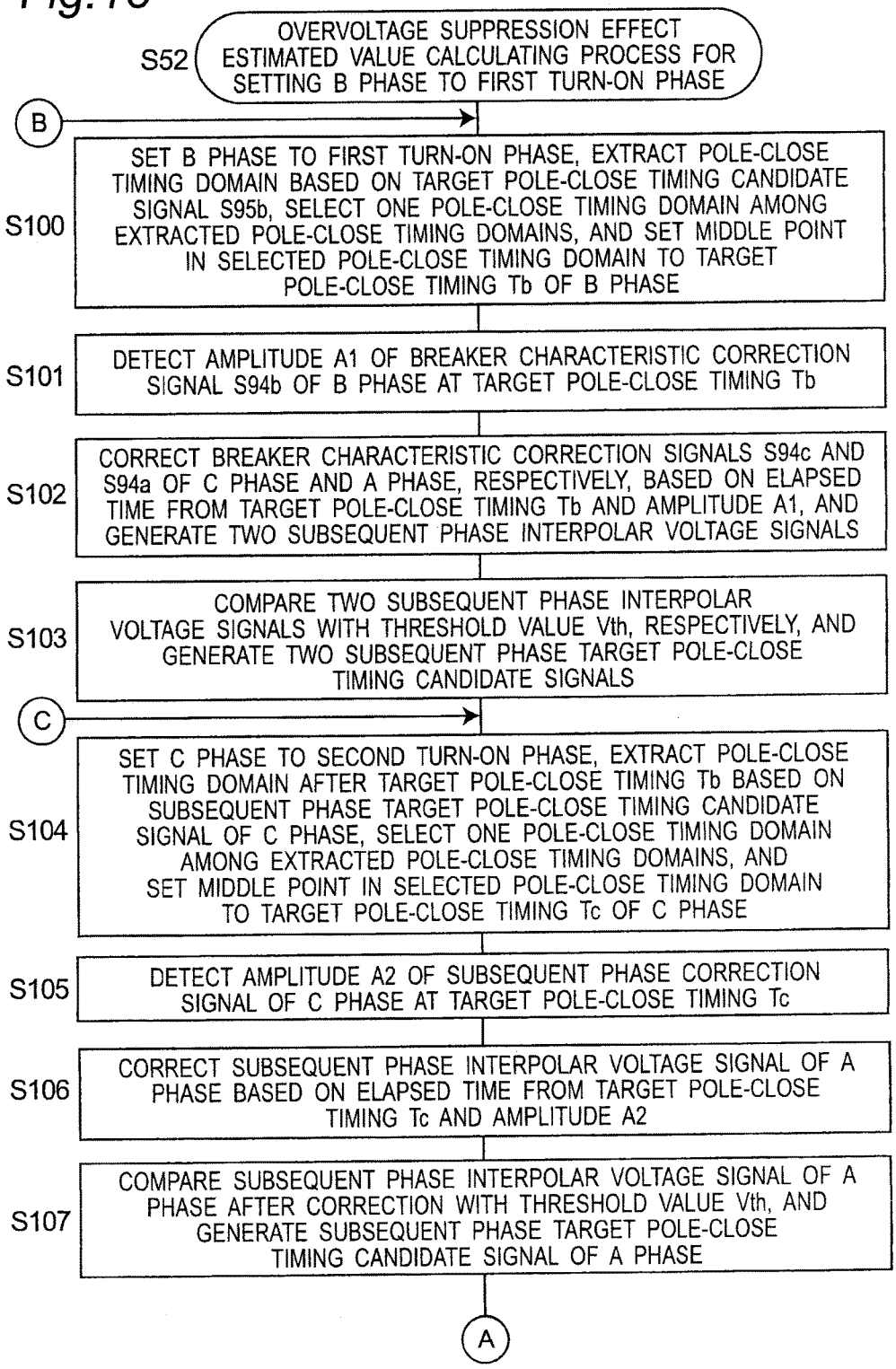
FIG. 18 is a flow chart showing a first portion of an overvoltage suppression effect estimated value calculating process for setting a B phase to the first turn-on phase executed in step S52 of FIG. 15.
Figure 19:
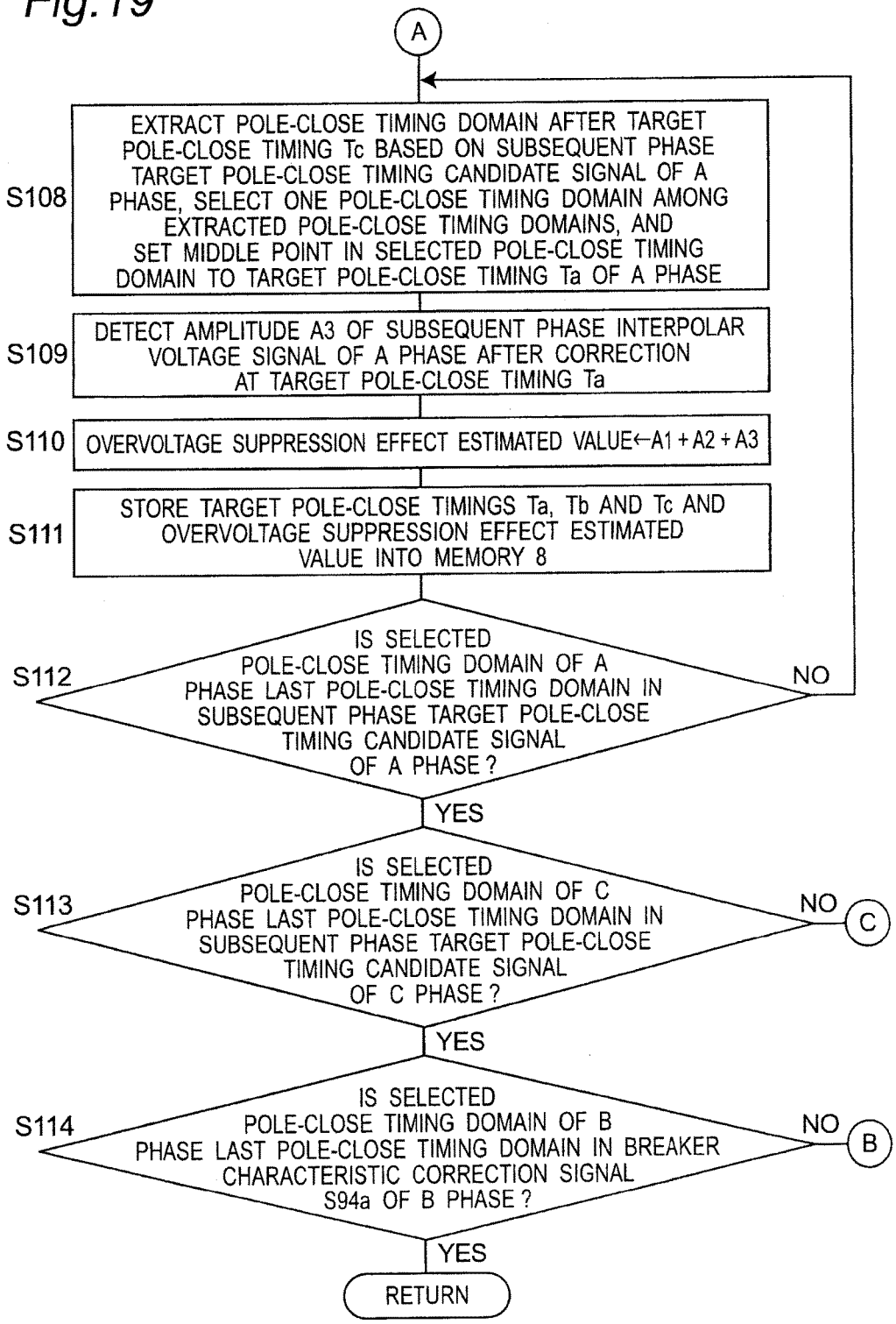
FIG. 19 is a flow chart showing a second portion of the overvoltage suppression effect estimated value calculating process for setting the B phase to the first turn-on phase executed in step S52 of FIG. 15.

Referring back to FIG. 15, in step S52 after step S51, the target pole-close timing determining unit 9 executes the overvoltage suppression effect estimated value calculating process for setting the B phase to the first turn-on phase. FIG. 18 is a flow chart showing a first portion of the overvoltage suppression effect estimated value calculating process for setting the B phase to the first turn-on phase executed in step S52 of FIG. 15, and FIG. 19 is a flow chart showing a second portion of the overvoltage suppression effect estimated value calculating process for setting the B phase to the first turn-on phase executed in step S52 of FIG. 15. The processes of FIGS. 18 and 19 are obtained by replacing the A phase, the B phase and the C phase with the B phase, the C phase and the A phase, respectively, in the processes of FIGS. 16 and 17. Since the processes of FIGS. 18 and 19 are similar to the processes of FIGS. 16 and 17, no description is provided therefor. The target pole-close timing determining unit 9 calculates the overvoltage suppression effect estimated values regarding all the turn-on orders and combinations of the target pole-close timings Ta, Tb and Tc when the B phase is the first turn-on phase by executing the processes of FIGS. 18 and 19, and stores the calculated the overvoltage suppression effect estimated values into the memory 8.

Referring back to FIG. 15, in step S53 after step S52, the target pole-close timing determining unit 9 executes the overvoltage suppression effect estimated value calculating process for setting the C phase to the first turn-on phase.

Figure 20:
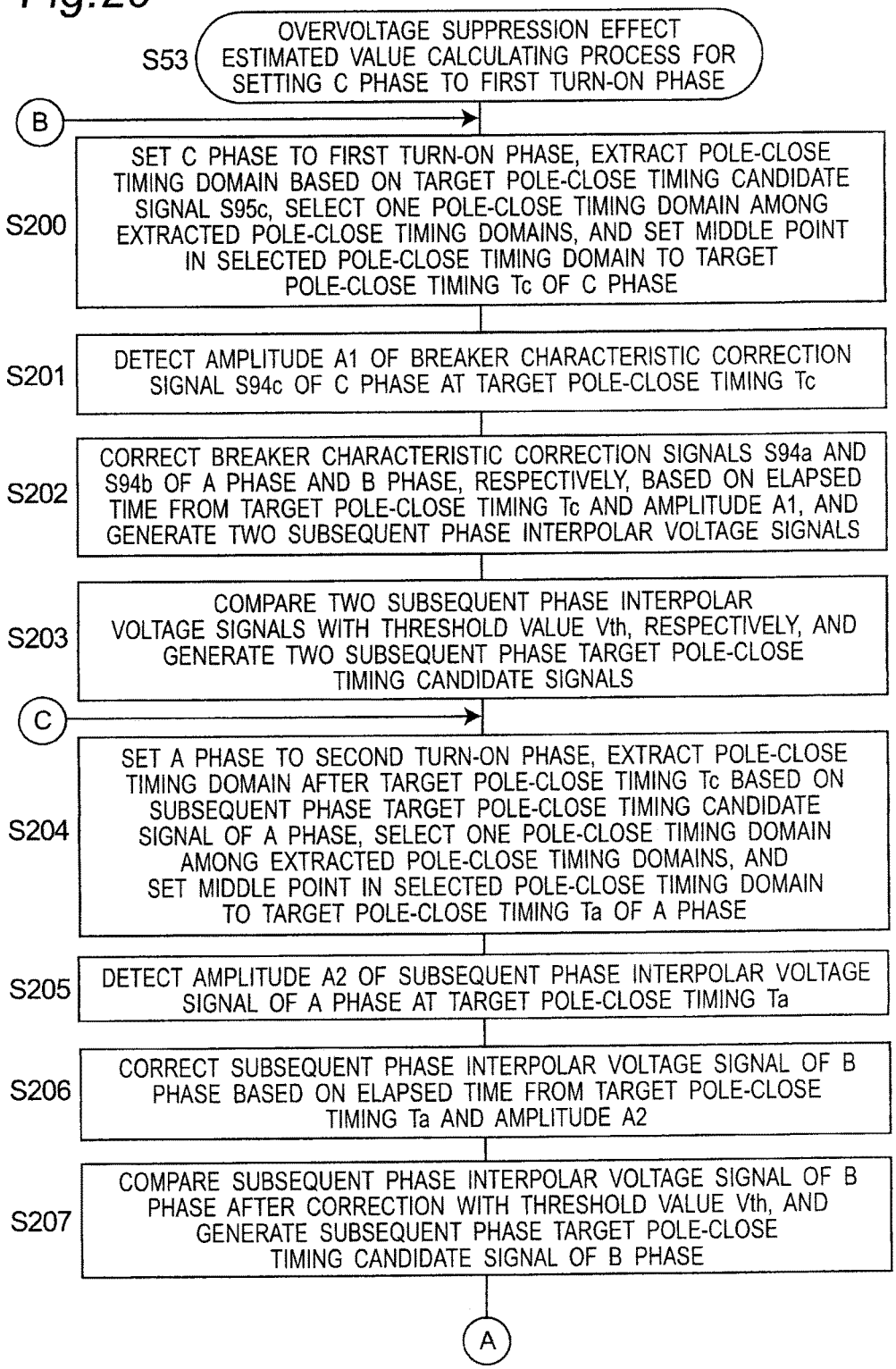
FIG. 20 is a flow chart showing a first portion of an overvoltage suppression effect estimated value calculating process for setting a C phase to the first turn-on phase executed in step S53 of FIG. 15.
Figure 21:
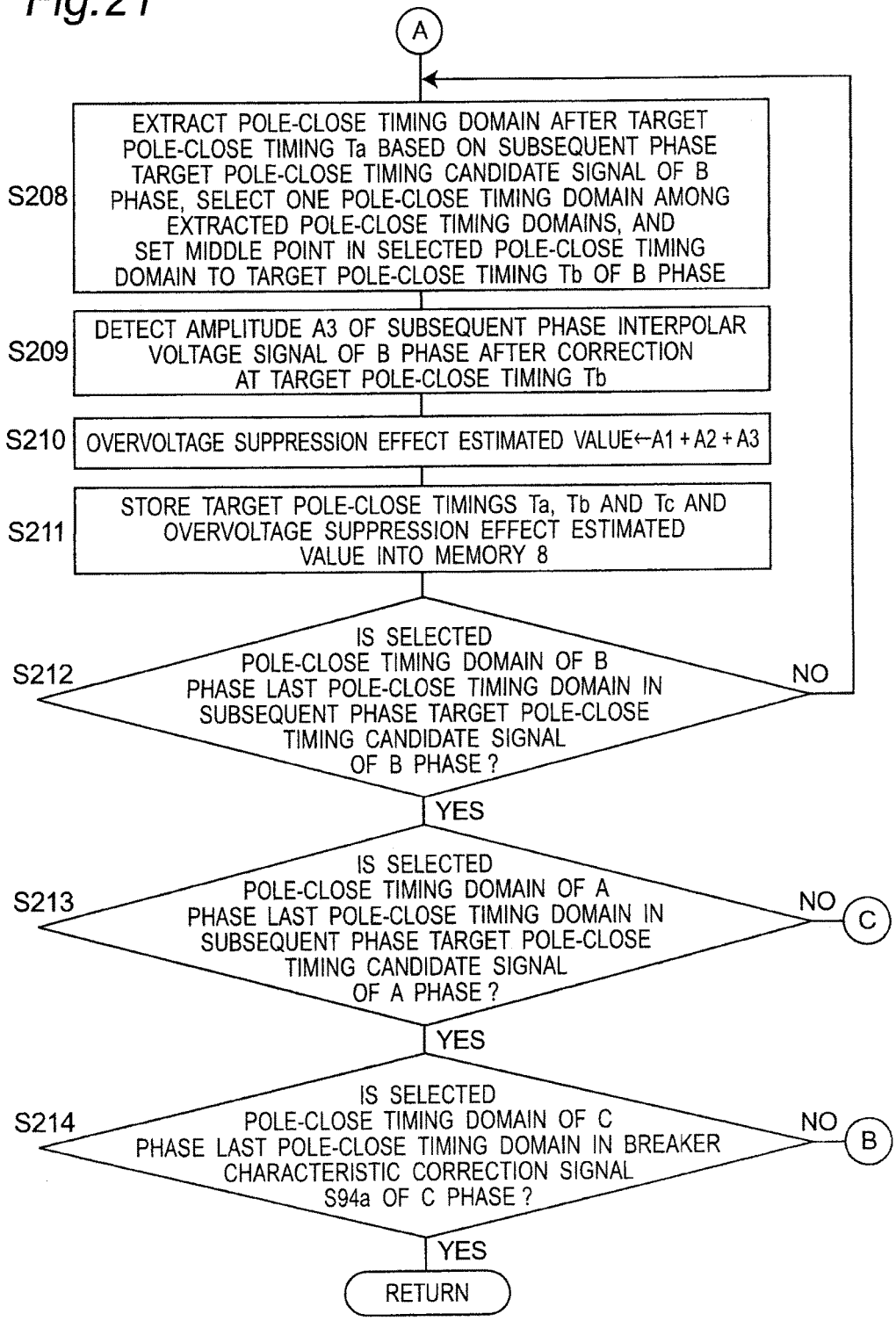
FIG. 21 is a flow chart showing a second portion of the overvoltage suppression effect estimated value calculating process for setting the C phase to the first turn-on phase executed in step S53 of FIG. 15.

FIG. 20 is a flow chart showing a first portion of the overvoltage suppression effect estimated value calculating process for setting the C phase to the first turn-on phase executed in step S53 of FIG. 15, and FIG. 21 is a flow chart showing a second portion of the overvoltage suppression effect estimated value calculating process for setting the C phase to the first turn-on phase executed in step S53 of FIG. 15. The processes of FIGS. 20 and 21 are obtained by replacing the A phase, the B phase and the C phase with the C phase, the A phase and the B phase, respectively, in the processes of FIGS. 16 and 17. Since the processes of FIGS. 20 and 21 are similar to the processes of FIGS. 16 and 17, no description is provided therefor. The target pole-close timing determining unit 9 calculates the overvoltage suppression effect estimated values regarding all the turn-on orders and combinations of the target pole-close timings Ta, Tb and Tc when the C phase is the first turn-on phase by executing the processes of FIGS. 20 and 21, and stores the calculated overvoltage suppression effect estimated values into the memory 8. Finally, in step S54 of FIG. 15, the target pole-close timing determining unit 9 outputs such a combination that the overvoltage suppression effect estimated value is minimized among the combinations of the target pole-close timings Ta, Tb and Tc stored in the memory 8 to the pole-close control unit 11, and the target pole-close timing determining process is ended.

As described above, according to the present embodiment, the target pole-close timing determining unit 9 corrects of the fluctuation in the absolute value of the interpolar voltage of the subsequent turn-on phase attributed to the fluctuation in the load side voltage of the subsequent turn-on phase in accordance with the turning-on of the preceding turn-on phase based on the elapsed time from the target pole-close timing of the preceding turn-on phase and the absolute value of the interpolar voltage value at the target pole-close timing of the preceding turn-on phase. Further, the target pole-close timing determining unit 9 calculates the overvoltage suppression effect estimated value regarding all the combinations of the target pole-close timings of the phases, and outputs the combination of the target pole-close timings when the overvoltage suppression effect estimated value is minimized to the pole-close control unit 11. Therefore, each of the phases can be closed at the target pole-close timings Ta, Tb and Tc when the elapsed time from the pole-close of the preceding turn-on phase to the pole-close of the subsequent phase is as small as possible and the sum total of the absolute values of the interpolar voltages at the turn-on timing become minimized, and therefore, the overvoltage generated at the timing of turning on the power transmission line can be suppressed.

Moreover, the breaker characteristic correction signal of the subsequent turn-on phase is corrected by using the correction amount Cv proportional to the absolute value of the interpolar voltage at the timing of turning on the preceding turn-on phase, and therefore, the overvoltage suppression effect estimated value becomes smaller as the absolute value of the interpolar voltage at the timing of turning on the preceding turn-on phase is smaller. Therefore, the absolute value of the interpolar voltage at the timing of turning on each subsequent turn-on phase can be reduced by comparison to the prior art.

Although the target pole-close timing determining unit 9-calculates the overvoltage suppression effect estimated value regarding all the turn-on orders and combinations of the target pole-close timings Ta, Tb and Tc in the present embodiment, the present invention is not limited to this. The target pole-close timing determining unit 9 may output a combination of the target pole-close timings Ta, Tb and Tc when the overvoltage suppression effect estimated value which is equal to or smaller than a predetermined threshold value is first obtained to the pole-close control unit 11 in the target pole-close timing determining process of FIG. 15.

Moreover, although the sum total of the amplitudes A1, A2 and A3 is used as the overvoltage suppression effect estimated value in the present embodiment, the present invention is not limited to this. The reciprocal of the sum total of the amplitudes A1, A2 and A3 may be used as the overvoltage suppression effect estimated value. In this case, the target pole-close timing determining unit 9 outputs the combination of the target pole-close timings Ta, Tb and Tc when the overvoltage suppression effect estimated value is maximized to the pole-close control unit 11.

Moreover, although the correction amount Cv is proportional to the absolute value of the interpolar voltage at the target pole-close timing of the preceding turn-on phase in each of the aforementioned embodiments, the present invention is not limited to this. It is acceptable to preliminarily estimate the function of the correction amount Cv concerning the absolute value of the interpolar voltage at the target pole-close timing of the preceding turn-on phase by experiments or a simulations and to determine the correction amount Cv by using the estimated function. It is noted that the absolute value of the interpolar voltage of the subsequent turn-on phase increases in accordance with an increase in the absolute value of the interpolar voltage at the timing of turning on the preceding turn-on phase. Therefore, the correction amount Cv should preferably be a monotonically increasing function concerning the absolute value of the interpolar voltage at the target pole-close timing of the preceding turn-on phase.

Further, although the correction amount Ct is proportional to the elapsed time from the target pole-close timing of the preceding turn-on phase in each of the aforementioned embodiments, the present invention is not limited to this. It is acceptable to preliminarily estimate the function of the correction amount Ct concerning the elapsed time from the target pole-close timing of the preceding turn-on phase by experiments or simulations and to determine the correction amount Ct by using the estimated function. It is noted that the absolute value of the interpolar voltage of the subsequent turn-on phase increases in accordance with an increase in the elapsed time from the target pole-close timing of the preceding turn-on phase. Therefore, the correction amount Ct should preferably be a monotonically increasing function concerning the elapsed time from the target pole-close timing of the preceding turn-on phase.

Furthermore, although the correction amounts Cv and Ct are used in each of the aforementioned embodiments, the present invention is not limited to this. It is acceptable to use only one of the correction amounts Cv and Ct.

Moreover, although the target pole-close timing determining unit 9 has added the correction amounts Cv and Ct to the absolute value of the interpolar voltage of the subsequent turn-on phase in each of the aforementioned embodiments, the present invention is not limited to this. The target pole-close timing determining unit 9 may calculate an increasing rate Mv of the absolute value of the interpolar voltage of the subsequent turn-on phase with respect to the absolute value of the interpolar voltage at the timing of turning on the preceding turn-on phase, and then multiply the absolute value of the interpolar voltage of the subsequent turn-on phase by the calculated increasing rate. It is noted that the absolute value of the interpolar voltage of the subsequent turn-on phase increases in accordance with an increase in the absolute value of the interpolar voltage at the timing of turning on the preceding turn-on phase. Therefore, the increasing rate Mv should preferably be a monotonically increasing function concerning the absolute value of the interpolar voltage at the target pole-close timing of the preceding turn-on phase.

Further, the target pole-close timing determining unit 9 may calculate an increasing rate Mt of the absolute value of the interpolar voltage of the subsequent turn-on phase with respect to the elapsed time from the target pole-close timing of the preceding turn-on phase and multiply the absolute value of the interpolar voltage of the subsequent turn-on phase by the calculated increasing rate. It is noted that the absolute value of the interpolar voltage of the subsequent turn-on phase increases in accordance with an increase in the elapsed time from the target pole-close timing of the preceding turn-on phase. Therefore, the increasing rate Mt should preferably be a monotonically increasing function concerning the elapsed time from the target pole-close timing of the preceding turn-on phase. Moreover, the target pole-close timing determining unit 9 may multiply the absolute value of the interpolar voltage of the turn-on phase by at least one of the increasing rates Mv and Mt.

In a case where the first turn-on phase is the A phase and the second turn-on phase is the B phase when the increasing rates Mv and Mt are used, the target pole-close timing determining unit 9 determines the target pole-close timings Ta and Tb as follows. The target pole-close timing determining unit 9 corrects the absolute value of the interpolar voltage of the contact 2*b* by setting the increasing rate Mv based on the absolute value (breaker characteristic correction signal S94*a*) of the interpolar voltage of the contact 2*a* at the target pole-close timing Ta, setting the increasing rate Mt based on the elapsed time from the target pole-close timing Ta, and multiplying the absolute value (breaker characteristic correction signal S94*a*) of the interpolar voltage of the contact 2*b* by the increasing rates Mv and Mt. In this case, the increasing rate Mv is set so as to increase in accordance with an increase in the absolute value (breaker characteristic correction signal S94*a*) of the interpolar voltage of the contact 2*a* at the target pole-close timing Ta. Further, the increasing rate Mt is set so as to increase in accordance with an increase in the elapsed time from the target pole-close timing Ta.

Furthermore, although the power transmission lines 3*a*, 3*b* and 3*c* are the power transmission lines provided with shunt reactor compensation in each of the aforementioned embodiments, the present invention is not limited to this but allowed to be power transmission lines provided with no shunt reactor compensation. In this case, the load side voltages V2*a*, V2*b* and V2*c* after the interruption of the breaker 2 become dc voltages that depend on the power source side voltages V1*a*, V1*b* and V is at the interruption timing. Moreover, the load side voltages V2*a*, V2*b* and V2*c* after interruption can be estimated by using a known technology based on the power source side voltages V1*a*, V1*b* and V1*c* before the interruption.

Moreover, although the present invention is described by taking the power source 1 of the three-phase alternating-current power source as an example in each of the aforementioned embodiments, the present invention is not limited to this but allowed to be applied to a multiphase alternating-current power source of at least two phases.

INDUSTRIAL APPLICABILITY

As described above, according to the power switching control apparatus and the control method thereof of the present invention, the absolute value of the interpolar voltage of the second contact is corrected based on at least one of the absolute value of the interpolar voltage of the first contact at the first target pole-close timing and the elapsed time from the first target pole-close timing, and the second target pole-close timing is set to the timing when the absolute value of the corrected interpolar voltage of the second contact is equal to or smaller than the first threshold value. Therefore, the generation of the transit voltage and current at the timing of turning on the breaker can be reliably suppressed by comparison to the prior art.

REFERENCE NUMERICALS

1: power source; 2: breaker; 2*a*, 2*b*, 2*c*: contact; 3*a*, 3*b*, 3*c*: power transmission line; 4, 5: voltage measuring unit; 6, 7: A/D converter; 8: memory; 9: target pole-close timing determining unit; 10: pole-close time interval estimating unit; 11: pole-close control unit.

The invention claimed is:

1. A power switching control apparatus comprising:

a first voltage measuring unit configured to measure a first voltage that is a power source side voltage of a first contact of a breaker connected between an alternating current power source of at least two phases and a load, and a second voltage that is a power source side voltage of a second contact of the breaker;

a second voltage measuring unit configured to measure a third voltage that is a load side voltage of the first contact, and a fourth voltage that is a load side voltage of the second contact;

a target pole-close timing determining unit configured to determine a first target pole-close timing of the first contact, and a second target pole-close timing of the second contact by using the first to fourth voltages; and a pole-close control unit configured to control the first and second contacts to be closed, respectively, at first and second target pole-close timings, wherein the target pole-close timing determining unit estimates an absolute value of an interpolar voltage of the first contact at and after a current time by using the first and third voltages, and estimates an absolute value of an interpolar voltage of the second contact at and after the current time by using the second and fourth voltages, the target pole-close timing determining unit sets the first target pole-close timing to a timing when the absolute value of the interpolar voltage of the first contact is equal to or smaller than a predetermined first threshold value, and the target pole-close timing determining unit corrects an absolute value of the interpolar voltage of the second contact based on at least one of the absolute value of the interpolar voltage of the first contact at the first target pole-close timing and an elapsed time from the first target pole-close timing, and sets the second target pole-close timing to a timing when an absolute value of a corrected interpolar voltage of the second contact is equal to or smaller than the first threshold value.

2. The power switching control apparatus as claimed in claim 1, wherein the target pole-close timing determining unit sets a first correction amount based on the absolute value of the interpolar voltage of the first contact at the first target pole-close timing, and corrects the absolute value of the interpolar voltage of the second contact based on the absolute value of the interpolar voltage of the first contact at the first target pole-close timing by adding the first correction amount to the absolute value of the interpolar voltage of the second contact.

3. The power switching control apparatus as claimed in claim 2, wherein the first correction amount is set so as to increase in accordance with an increase in the absolute value of the interpolar voltage of the first contact at the first target pole-close timing.

4. The power switching control apparatus as claimed in claim 1, wherein the target pole-close timing determining unit sets a second correction amount based on the elapsed time from the first target pole-close timing, and corrects the absolute value of the interpolar voltage of the second contact based on the elapsed time from the first target pole-close timing by adding the second correction amount to the absolute value of the interpolar voltage of the second contact.

5. The power switching control apparatus as claimed in claim 4, wherein the second correction amount is set so as to increase in accordance with an increase in the elapsed time from the first target pole-close timing.

6. The power switching control apparatus as claimed in claim 1, wherein the target pole-close timing determining unit sets a first increasing rate based on the absolute value of the interpolar voltage of the first contact at the first target pole-close timing, and corrects the absolute value of the interpolar voltage of the second contact based on the absolute value of the interpolar voltage of the first contact at the first target pole-close timing by multiplying the absolute value of the interpolar voltage of the second contact by the first increasing rate.

7. The power switching control apparatus as claimed in claim 6, wherein the first increasing rate is set so as to increase in accordance with an increase in the absolute value of the interpolar voltage of the first contact at the first target pole-close timing.

8. The power switching control apparatus as claimed in claim 1, wherein the target pole-close timing determining unit sets a second increasing rate based on the elapsed time from the first target pole-close timing, and corrects the absolute value of the interpolar voltage of the second contact based on the elapsed time from the first target pole-close timing by multiplying the absolute value of the interpolar voltage of the second contact by the second increasing rate.

9. The power switching control apparatus as claimed in claim 8, wherein the second increasing rate is set so as to increase in accordance with an increase in the elapsed time from the first target pole-close timing.

10. The power switching control apparatus as claimed in claim 1, wherein the target pole-close timing determining unit calculates an overvoltage suppression effect estimated value based on the absolute value of the interpolar voltage of the first contact at the first target pole-close timing and the absolute value of the corrected interpolar voltage of the second contact at timings when the absolute value of the corrected interpolar voltage of the second contact is equal to or smaller than the first threshold value, and determines the second target pole-close timing to be a timing when an overvoltage suppression effect estimated value satisfies a predetermined threshold value condition among the timings.

11. The power switching control apparatus as claimed in claim 10, wherein the overvoltage suppression effect estimated value at each of the timings is a sum of the absolute value of the interpolar voltage of the first contact at the first target pole-close timing and the absolute value of the corrected interpolar voltage of the second contact, and wherein the threshold value condition is defined by that the overvoltage suppression effect estimated value is equal to or smaller than a predetermined second threshold value.

12. The power switching control apparatus as claimed in claim 10, wherein the target pole-close timing determining unit determines the second target pole-close timing to be a timing when the overvoltage suppression effect estimated value is maximum among the timings.

13. The power switching control apparatus as claimed in claim 12, wherein the overvoltage suppression effect estimated value at each of the timings is a reciprocal of a sum of the absolute value of the interpolar voltage of the first contact at the first target pole-close timing, and the absolute value of the corrected interpolar voltage of the second contact.

14. The power switching control apparatus as claimed in claim 1, wherein the pole-close control unit outputs a first pole-close control signal for closing the first contact to the first contact at a timing preceding from the first target pole-close timing by a predetermined estimated pole-close time interval, and outputs a second pole-close control signal for closing the second contact to the second contact at a timing preceding from the second target pole-close timing by the estimated pole-close time interval.

15. The power switching control apparatus as claimed in claim 1, wherein the target pole-close timing determining unit corrects the absolute value of the interpolar voltage of the first contact and the absolute value of the interpolar voltage of the second contact based on a pre-arc characteristic and an operational variation characteristic of the breaker.

16. The power switching control apparatus as claimed in claim 1, wherein the alternating current power source is a three-phase current power source, wherein the first voltage measuring unit further measures a fifth voltage that is a power source side voltage of a third contact of the breaker, wherein the second voltage measuring unit further measures a sixth voltage that is a load side voltage of the third contact, and wherein the target pole-close timing determining unit estimates the absolute value of the interpolar voltage of the third contact at and after the current time by using the fifth and sixth voltages, corrects the absolute value of the interpolar voltage of the third contact based on at least one of the absolute value of the interpolar voltage of the first contact at the first target pole-close timing and the elapsed time from the first target pole-close timing, thereafter further corrects the absolute value of the corrected interpolar voltage of the third contact based on at least one of the absolute value of the corrected interpolar voltage of the second contact at the second target pole-close timing and an elapsed time from the second target pole-close timing, and sets a third target pole-close timing of the third contact to a timing when the absolute value of the further corrected interpolar voltage of the third contact is equal to or smaller than the first threshold value, and wherein the pole-close timing control unit controls the third contact to be closed at a third target pole-close timing.

17. A control method of controlling a power switching control apparatus, wherein the power switching control apparatus comprises:

a first voltage measuring unit configured to measure a first voltage that is a power source side voltage of a first contact of a breaker connected between an alternating current power source of at least two phases and a load, and a second voltage that is a power source side voltage of a second contact of the breaker;

a second voltage measuring unit configured to measure a third voltage that is a load side voltage of the first contact, and a fourth voltage that is a load side voltage of the second contact;

a target pole-close timing determining unit configured to determine a first target pole-close timing of the first contact, and a second target pole-close timing of the second contact by using the first to fourth voltages; and a pole-close control unit configured to control the first and second contacts to be closed, respectively, at first and second target pole-close timings, wherein the control method comprises steps of:

estimating an absolute value of the interpolar voltage of the first contact at and after a current time by using the first and third voltages, and estimating an absolute value of the interpolar voltage of the second contact at and after the current time by using the second and fourth voltages by the target pole-close timing determining unit;

setting the first target pole-close timing to a timing when the absolute value of the interpolar voltage of the first contact is equal to or smaller than a predetermined first threshold value by the target pole-close timing determining unit; and correcting the absolute value of the interpolar voltage of the second contact based on at least one of the absolute value of the interpolar voltage of the first contact at the first target pole-close timing and an elapsed time from the first target pole-close timing, and correcting the second target pole-close timing to a timing when the absolute value of the corrected interpolar voltage of the second contact is equal to or smaller than the first threshold value by the target pole-close timing determining unit.

* * * * *